US005625860A

United States Patent [19]

Maeda et al.

[11] Patent Number: 5,625,860

[45] Date of Patent: Apr. 29, 1997

[54] IMAGE FORMING APPARATUS WITH CONTROL MEANS FOR COORDINATING IMAGE FORMATION AND PROCESSING OPERATIONS SO AS TO PROVIDE FOR MORE EFFICIENT OVERALL OPERATION

[75] Inventors: Koji Maeda; Yoshiki Yoshioka; Junichi Oura; Hidehiro Tabuchi, all of Osaka, Japan

[73] Assignee: Mita Industrial Co., Ltd., Osaka, Japan

[21] Appl. No.: 603,864

[22] Filed: Feb. 22, 1996

[30] Foreign Application Priority Data

Mar. 6, 1995 [JP] Japan ..... 7-045989
Mar. 6, 1995 [JP] Japan ..... 7-045990

[51] Int. Cl.[6] ..... G03G 15/00

[52] U.S. Cl. ..... 399/403; 271/288; 271/298; 399/407; 399/410

[58] Field of Search ..... 355/321, 323, 355/324, 314, 208; 271/298, 288, 289, 292, 294; 270/58.07, 58.08, 58.09

[56] References Cited

U.S. PATENT DOCUMENTS 4,693,590 9/1987 Umeda ..... 355/313
4,917,366 4/1990 Murakami et al. ..... 270/58.09
5,509,645 4/1996 Shinno et al. ..... 270/58 X
5,535,012 7/1996 Matsumoto et al. ..... 358/400 X

FOREIGN PATENT DOCUMENTS 57-68861 4/1982 Japan .
2-89771 3/1990 Japan .

*Primary Examiner*—Arthur T. Grimley
*Assistant Examiner*—Quana Grainger
*Attorney, Agent, or Firm*—Beveridge, DeGrandi, Weilacher & Young, LLP

[57] ABSTRACT

An image forming apparatus with a sorter which is capable of performing image formation even during the implementation of a post-process. The image forming apparatus includes the sorter which has a non-sort bin and sort bins for receiving sheets each formed with an image, and a post-processor for performing the post-process on sheets received by the sort bins. When an interruption mode is designated during the post-process, the image formation is permitted while the post-process is continuously performed. Further, the sorter is controlled to discharge a sheet formed with an image into the non-sort bin. Thus, the image formation can be performed concurrently with post-process. Since the sheet formed with the image is discharged into the non-sort bin which is adapted not to receive sheets to be subjected to the post process, a jam will not occur even if an error occurs during the post-process.

37 Claims, 15 Drawing Sheets

IMAGE FORMING APPARATUS WITH CONTROL MEANS FOR COORDINATING IMAGE FORMATION AND PROCESSING OPERATIONS SO AS TO PROVIDE FOR MORE EFFICIENT OVERALL OPERATION

BACKGROUND OF THE INVENTION

1. Field of the Invention

The present invention relates to an image forming apparatus such as a copying machine and, more particularly, to an image forming apparatus having a sorter for sorting and discharging a plurality of sheets respectively formed with identical images into a plurality of sort bins.

2. Description of Related Arts

Conventionally, copying machines have been widely used which electrophotographically make copies of a document original. Such copying machines are adapted to optically scan a document original, form an electrostatic latent image on a photoreceptor based on the scanned image, develop the electrostatic latent image into a toner image, and transfer the toner image onto a copy sheet.

These copying machines, if necessary, are provided with a sorter for sorting a plurality of copy sheets respectively formed with identical images. The sorter is adapted to discharge copy sheets each carrying an image of a document original transferred thereon into a single non-sort bin and to sort and discharge a plurality of copy sheets respectively formed with identical images into a plurality of sort bins when a plurality of copies are made from a single document original.

The copying machine with a sorter have a non-sort mode and a sort mode which are selectively set in the copying machine body thereof. In the non-sort mode, copy sheets formed with images are discharged into a non-sort bin. In the sort mode, copy sheets formed with images are discharged into sort bins.

Some of the copying machines with sorters can perform so-called post-processes when the sort mode is designated. The post-processes include a stapling process, a punching process and a stacking process. In the stapling process, a plurality of copy sheets discharged into each sort bin are stapled by means of a stapler. In the punching process, a plurality of copy sheets discharged into each sort bin are punched. In the stacking process, sets of copies which have been subjected to the stapling process are stacked in a stack section, so that the sets of copies can be easily taken out.

Where an error occurs during the stapling process in a copying machine with a sorter capable of performing such post-processes, for example, the entrance of a sort bin may be blocked by discharged copy sheets. The copy sheet blocking the entrance of the sort bin may interfere with the discharge of the next copy sheet formed with an image of a document original, thereby causing a jam. To avoid the jam, the copying machine is prohibited from performing a copying operation in the copying machine body thereof during the post-process.

Therefore, it takes time for the copying machine to return to a stand-by state for the next copying operation after the post-process. For example, about two to three seconds are required for stapling a set of copies. Therefore, the stapling of 20 sets of copies requires 40 seconds to one minute.

The copying machine further includes an image formation section for performing the copying operation to form an image on a copy sheet and, as required, optional-function performing means. The optional-function performing means include, for example, an automatic document original sheet feeder for feeding document original sheets one by one, a large volume sheet deck accommodating a large amount of copy sheets and having a lift for lifting the copy sheets to a position for feeding a copy sheet, an intermediate tray to be used for a two-side copying operation for forming images on both sides of a copy sheet, and the like.

These optional-function performing means are respectively controlled by independent controllers each comprising a microcomputer. The controllers are electrically connected to a central controller for controlling the entire operation of the copying machine as well as the operation of the image formation section.

When an error occurs in any of the optional-function performing means in the copying machine, the central controller is informed of the occurrence of the error. For example, a malfunction of a driving motor for driving a sheet feeding roller for taking in a document original sheet may occur in the automatic document original sheet feeder. At this time, a controller for controlling the automatic document original sheet feeder outputs an error occurrence signal to the central controller. In response thereto, the central controller prohibits the entire operation of the copying machine including a basic copying operation.

The sorter is also one of the optional-function performing means. Therefore, the operation of the sorter is controlled by an independent controller which is electrically connected to the central controller. When an error occurs in the sorter, the entire operation of the copying machine is prohibited. This is because the malfunction of the sorter may cause a jam and the like when a copy sheet formed with an image is discharged through the sorter.

Thus, the malfunction of the sorter prevents the copying machine from performing the copying operation. This means that a user cannot use the copying machine until a technical service person completes the repair of the sorter. That is, an office work requiring copy making is retarded. This problem is even more critical in case that the copying machine is used in a rural area where the user may have to wait for several days for the technical service person to come to repair the copying machine.

SUMMARY OF THE INVENTION

It is therefore an object of the present invention to provide an image forming apparatus with a sorter which is capable of performing image formation during a post-process.

It is another object of the present invention to provide an image forming apparatus which is capable of performing image formation even when an error occurs in processing means for performing a predetermined process on sheets each formed with an image.

In accordance with the present invention, an image forming apparatus includes a sorter having first and second sheet receiving portions for receiving sheets each formed with an image and post-processing means for performing a post-process on a sheet received by the second sheet receiving portion. The image forming apparatus further includes interruption mode setting means for designating an interruption mode. When the interruption mode is designated during the post-process, image forming means is permitted to perform image formation while the post-process is continuously performed. Further, the sorter is controlled so that a sheet formed with an image is received by the first sheet receiving portion.

The image formation can be performed concurrently with the implementation of the post-process, so that a user does not have to wait for the completion of the post-process. Therefore, time required for the image formation can be shortened for efficient office work. Further, the sheet formed with the image is not discharged into the second sheet receiving portion to which a sheet to be subjected to the post-process has been discharged, but into the first sheet receiving portion. Even if the error occurs during the post-process, the entrance of the first sheet receiving portion is not blocked, thereby preventing a jam.

The first sheet receiving portion may be a non-sort bin which is used when the sheets each formed with an image are not to be sorted. The second sheet receiving portion may include a plurality of sort bins which is used when the sheets each formed with an image are to be sorted.

The post-process may be a stapling process for stapling a plurality of sheets each formed with an image, a punching process for punching a sheet formed with an image, or a sheet take-out process for taking out sheets each formed with an image to stack the sheets in a stack section.

In accordance with the present invention, where an error occurs in processing means for performing a predetermined process on a sheet formed with an image, the processing means is prohibited from performing the predetermined process and the image forming means is permitted to perform the image formation.

Thus, even if an error occurs in the processing means, the image formation can be performed, thereby avoiding such an inconvenience that the image formation cannot be performed until the completion of the repair of the processing means. Where the image forming apparatus is used in a rural area and a user thereof may have to wait for a long time for a technical service person to come to repair the processing means, for example, it is a significant merit for the user to perform the image formation before the completion of the repair of the processing means.

The processing means may be a sorting mechanism for sorting and discharging a plurality of sheets each formed with an image into a plurality of bins. In this case, the sorter of the image forming apparatus may include the non-sort bin, the plurality of sort bins, and the sorting mechanism. If an error occurs in the sorting mechanism, a sheet formed with an image is forcibly discharged into the non-sort bin. Although an image forming operation in a so-called sort mode is prohibited, the usual image formation can be implemented.

Since the sheet formed with the image is forcibly discharged into the non-sort bin, the occurrence of a jam can be assuredly prevented.

The processing means may include stapling means for stapling a plurality of sheets each formed with an image. The processing means may further include punching means for punching a sheet formed with an image. The processing means may still further include take-out means for taking out sheets each formed with an image to stack the sheets in the stack section.

In accordance with one embodiment of the present invention, the processing means includes a plurality of functional sections for performing different operations on a sheet formed with an image. In this case, the image forming apparatus preferably further includes means for outputting error section identification data indicative of which functional section causes an error. The functional section specified by the error section identification data is prohibited from performing its operation, while the other normal functional sections are permitted to perform their respective operations. This minimizes the number of unavailable functions. Where the processing means are adapted to perform the stapling process and punching process and an error occurs in a functional section for the stapling process, for example, the implementation of the punching process is permitted.

Further, the image forming apparatus preferably once prohibits the image formation when an error occurs in the processing means, and judges whether or not the error is a noncritical one which can be readily removed. If the error is noncritical, the prohibition of the image formation is preferably withdrawn after the error is removed. If the error is a critical one which cannot be readily removed, the image formation is preferably permitted after the operation of processing means is prohibited. The noncritical error includes, for example, those which can be easily removed by a user. Therefore, after the user takes appropriate measures to remove the error, the image forming apparatus can operate as usual.

With the image forming apparatus according to the present invention, the image formation can be performed even if an error occurs in the processing means. Therefore, there is a possibility that the user does not recognize the occurrence of the error. For this reason, the user is preferably informed of the occurrence of the error in the processing means, thereby promptly taking appropriate measures to remove the error.

Where the processing means includes a plurality of functional sections, the user is preferably informed of which functional section causes an error.

In accordance with another embodiment of the present invention, the processing means can be physically disconnected from the machine body of the image forming apparatus. When an error occurs in the processing means, the image forming means is permitted to perform the image formation on condition that the processing means is disconnected.

This assuredly prevents the malfunctioning processing means from performing the process on sheets each formed with an image.

More specifically, upon the occurrence of the error in the processing means, the image forming means is prohibited from performing the image formation, and the prohibition of the image formation is withdrawn after it is determined that the processing means is physically disconnected from the machine body.

Where the processing means is a sorter, for example, the implementation of the image formation is once prohibited when an error occurs in the sorter. By disconnecting the sorter from the machine body, the image forming apparatus is brought into a state where the image formation can be implemented. Thus, the occurrence of a jam can be prevented which may be caused by discharging a sheet formed with an image into the malfunctioning sorter by mistake.

Where the error is a noncritical one which can be readily removed, the prohibition of the image formation is preferably withdrawn after the error is removed.

The user is preferably informed of a need to disconnect the processing means when an error occurs in the processing means.

Where the processing means includes a plurality of functional sections, the operations of the other normal functional sections are permitted on condition that the malfunctioning functional section is disconnected, and the image forming means is preferably permitted to perform the image formation. The image forming apparatus can use the normal functional sections and, therefore, can operate in an almost normal state.

In this case, the user is preferably informed of a need to disconnect the malfunctioning functional section.

When an error occurs in the processing means, the image forming means is preferably permitted to perform the image formation on condition that a sheet receiving tray for receiving a sheet formed with an image is attached to the machine body. This is because another means is required for receiving the sheet after the processing means for processing the sheet is disconnected from the machine body. Therefore, sheets formed with images are prevented from scattering around on a floor by permitting the image formation on condition that the sheet receiving tray is attached to the machine body.

The foregoing and other objects, features and effects of the present invention will become apparent from the following detailed description of preferred embodiments with reference to the attached drawings.

DETAILED DESCRIPTION OF PREFERRED EMBODIMENTS

EMBODIMENT 1

Figure 1:
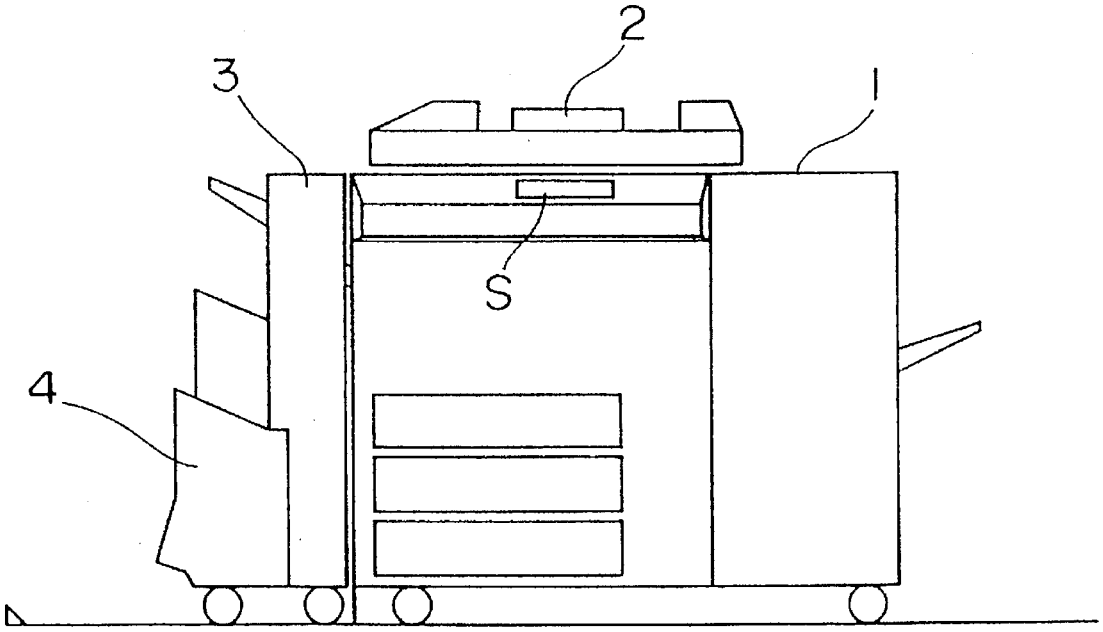
FIG. 1 is a schematic diagram illustrating the external construction of a copying machine in accordance with a first embodiment of the present invention.

FIG. 1 is a front view illustrating the external construction of a copying machine in accordance with a first embodiment of an image forming apparatus with a sorter of the present invention. The copying machine has a copying machine body 1, an automatic document original sheet feeder (hereinafter referred to as "RDH") 2 disposed on a top surface of the copying machine body 1, a sorter 3 for receiving copy sheets discharged from the copying machine body 1, and a stacker 4 for collectively stacking the copy sheets received by the sorter 3. On an upper portion of the front face of the copying machine body 1 is disposed an operation section S with which an operator designates the operation mode of the copying machine.

Figure 2:
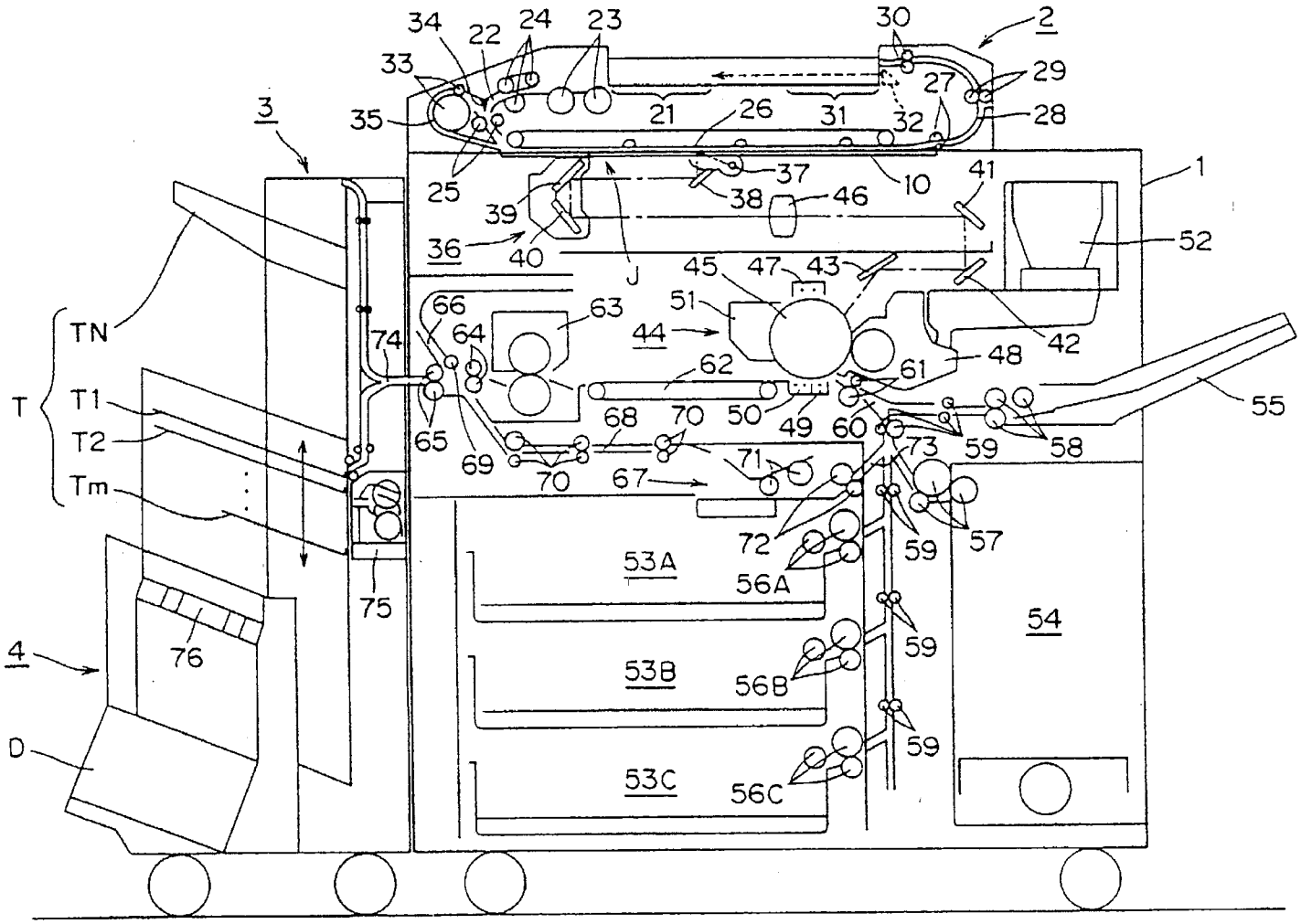
FIG. 2 is a schematic diagram illustrating the internal construction of the copying machine.

FIG. 2 is a schematic diagram illustrating the internal construction of the copying machine. On the top surface of the copying machine body 1 is disposed a transparent document original platen 10. When a copying operation is performed, a document original sheet to be copied is placed in an image formation position (light exposure position) J on the document original platen 10.

The RDH 2 automatically feeds a document original sheet to the image formation position J on the document original platen 10. The RDH 2 includes sheet feeding rollers 23, 24, 25, and a transportation belt 26, by means of which document original sheets set in a document original sheet setting position 21 are taken out one by one from the bottom side thereof, and fed to the image formation position J through a sheet feeding path 22 extending to the document original platen 10.

The RDH 2 further includes reversing rollers 33 for reversing a two-sided document original sheet once fed to the image formation position J and feeding the document original sheet again to the image formation position J. The reversing rollers 33 are useful where images on a two-sided document original sheet are copied on the both sides of a copy sheet in a two-side copy mode or where images on a two-sided document original sheet are respectively copied on two copy sheets in a separate copy mode. First the back side and then the front side of the two-sided document original sheet are subjected to the copying operation. Therefore, after once being fed to the image formation position J, the two-sided document original sheet is returned to the sheet feeding path 22 by the transportation belt 26. By reversing the rotation of the sheet feeding rollers 25 and blocking the sheet feeding path 22 by a separation claw 34, the two-sided document original sheet is introduced into a reversion path 35. The two-sided document original sheet introduced into the reversion path 35 is further transported through the reversion path 35 by the rotation of the reversing rollers 33 and led again to the image formation position J. Thus, the back side of the two-sided document original sheet faces downward, and is subjected to the copying operation. Upon completion of the copying operation for the back side of the two-sided document original sheet, the document original sheet is reversed by the operations of the reversing rollers 33 and the like, and the front side of the document original sheet is subjected to the copying operation.

After being subjected to the copying operation, the document original sheet on the document original platen 10 is transported to the right in FIG. 2 by the transportation belt 26. The document original sheet is led to a sheet discharging path 28 by sheet discharging rollers 27, and discharged into a document original sheet discharging position 31 through relay rollers 29 and sheet discharging rollers 30. After being discharged to the document original sheet discharging position 31, all the document original sheets are automatically set again in the document original sheet setting position 21 by a document original guide plate 32.

A document original reading section 36 is disposed in the copying machine body 1. The document original reading section 36 has a light source 37 for irradiating and scanning a document original sheet placed in the image formation position J on the document original platen 10. The light source 37 is reciprocally driven along the document original platen 10 in a transverse direction of FIG. 2 by a driving force from a motor for the optical system (not shown). Light emitted from the light source 37 is reflected on the document original sheet placed in the image formation position J. The light reflected on the document original sheet is further reflected on a first reflection mirror 38 driven unitedly with the light source 37, and further reflected on a second reflection mirror 39, a third reflection mirror 40, a fourth reflection mirror 41, a fifth reflection mirror 42 and a sixth reflection mirror 43 to be led to a photoreceptor drum 45 in an image formation section 44.

When the light source is driven, the second reflection mirror 39 and third reflection mirror 40 are driven in a transverse direction of FIG. 2 at a speed half a speed at which the light source 37 is driven. Thus, the optical path length from the light source 37 to the photoreceptor drum 45 is kept constant during the scanning of the document original by the light from the light source 37. Between the third reflection mirror 40 and the fourth reflection mirror 41 is disposed a zoom lens 46 for forming a document original image on the photoreceptor drum 45.

The image formation section 44 includes the aforesaid photoreceptor drum 45 rotatively driven at a constant speed during the copying operation, and a main charger 47, a developing unit 48, a transfer charger 49, a separation charger 50 and a cleaning unit 51 which are disposed along the rotational direction around the photoreceptor drum 45 in the order named.

After being uniformly charged by the main charger 47, the surface of the photoreceptor drum 45 is exposed to the light reflected from the document original. As a result, an electrostatic latent image corresponding to a reversed document original image is formed on the surface of the photoreceptor drum 45. The electrostatic latent image is developed into a toner image with toner supplied from a toner hopper 52 in the developing unit 48. The toner image is transferred onto a copy sheet by the transfer charger 49. After the transfer of the toner image, residual toner present on the surface of the photoreceptor drum 45 is removed by the cleaning unit 51. The separation charger 50 serves to separate the copy sheet from the surface of the photoreceptor drum 45. The main charger 47, the transfer charger 49 and the separation charger 50 perform their respective functions by corona discharging.

In synchronization with the copying operation performed by the image formation section 44, a copy sheet is fed from any one of an upper deck 53A, a middle deck 53B, a lower deck 53C, a large volume deck 54 and a manual sheet feeding tray 55. The upper deck 53A, middle deck 53B and lower deck 53C respectively accommodate copy sheets of different sizes. The large volume deck 54 accommodates a large amount of copy sheets of a size which are to be frequently used. The manual sheet feeding tray 55 is used to feed preliminarily formatted copy sheets, for example.

Sheet feeding rollers 56A, 56B, 56c, 57 and 58 for taking out copy sheets one by one are respectively disposed in positions relative to the upper deck 53A, the middle deck 53B, the lower deck 53C, and the large volume deck 54 and the manual sheet feeding tray 55. During the copying operation, the sheet feeding rollers 56A, 56B, 56C, 57 or 58 are rotatively driven, thereby taking out a copy sheet from corresponding one of the upper deck 53A, middle deck 53B, lower deck 53C, large volume deck 54 and manual sheet feeding tray 55. The copy sheet thus taken out is introduced to a copy sheet transportation path 60 extending to the vicinity of the photoreceptor drum 45 via the relay rollers 59.

A pair of registration rollers 61 are disposed adjacent to the photoreceptor drum 45 on the sheet transportation path 60. The registration rollers 61 once stop the copy sheet, and then feed the copy sheet to the photoreceptor drum 45 in synchronization with the rotation of the photoreceptor drum 45. Thus, the copy sheet is fed to the photoreceptor drum 45 in such a timing as to be registered with the toner image formed on the surface of the photoreceptor drum 45 at the location of the transfer charger 49.

The copy sheet carrying the toner image transferred thereon by the transfer charger 49 is separated from the surface of the photoreceptor drum 45 by the separation charger 50, and then introduced to a fixation unit 63 by the transportation belt 62. The fixation unit 63 fixes the toner on the surface of the copy sheet. The copy sheet which has been subjected to the fixation process is transported to the sorter 3 by transportation rollers 64 and sheet discharging rollers 65.

A copy sheet transportation path extending from the transportation rollers 64 to the sheet discharging rollers 65 branches into an intermediate path 68 and a reversion path 66 for reversing the copy sheet which has been subjected to the fixation process. The intermediate path 68 serves to guide the copy sheet to an intermediate tray 67 disposed in a central portion of the copying machine body 1. Along the intermediate path 68 are disposed transportation rollers 70 at appropriate intervals. The intermediate tray 67 is used when the copying operation in the two-side copy mode or the separate copy mode is implemented.

In the two-side copy mode, a copy sheet which has been subjected to the fixation process is once introduced into the reversion path 66 by a separation claw (not shown) and a reversion roller 69, and then led to the intermediate path 68 by the reverse rotation of the reversion roller 69. Then, the copy sheet is accommodated in the intermediate tray 67. Copy sheets accommodated in the intermediate tray 67 are taken out one by one by sheet feeding rollers 71 and 72, then introduced into the transportation path 73 joining the sheet transportation path 60, and led again to the photoreceptor drum 45 through the sheet transportation path 60.

The sorter 3 has a plurality of bins T including bins TN, T1, T2, . . . Tm. The copy sheet discharged by the sheet feeding rollers 65 is introduced into a sheet discharging path 74 and then led to a predetermined bin T by a sorting mechanism (not shown). Of the plurality of bins T, the bin TN is a non-sort bin which is used when copy sheets are discharged without being sorted after the copying operation. The bins T1 to Tm are used as sort bins for receiving copy sheets which are sorted after the copying operation.

The sorter 3 further includes a punch/staple unit 75 for punching a plurality of copy sheets led to each of the sort bins T1 to Tm or stapling the plurality of copy sheets by means of a stapler. The sort bins T1 to Tm are vertically movable as shown in FIG. 2, so that a sort bin accommodating a set of copy sheets to be subjected to the punching or stapling process is moved to a position facing to the punch/staple unit 75.

The stacker 4 stacks the stack section D with sets of copy sheets each subjected to the stapling process in the punch/staple unit 75. The sets of copy sheets each subjected to the stapling process are taken out by means of a take-out device 76 in the stacker 4 and introduced to the stack section D.

The punching process, stapling process and stacking process will hereinafter be generally referred to as "post-process", if necessary. Electrical components including a sort bin driving section for driving the sort bins T1 to Tm, a punch/stapling unit driving section for driving the punch/staple unit 75 and a take-out device driving section for driving the take-out device 76 will hereinafter be generally referred to as "post-processor", if necessary.

Figure 3:
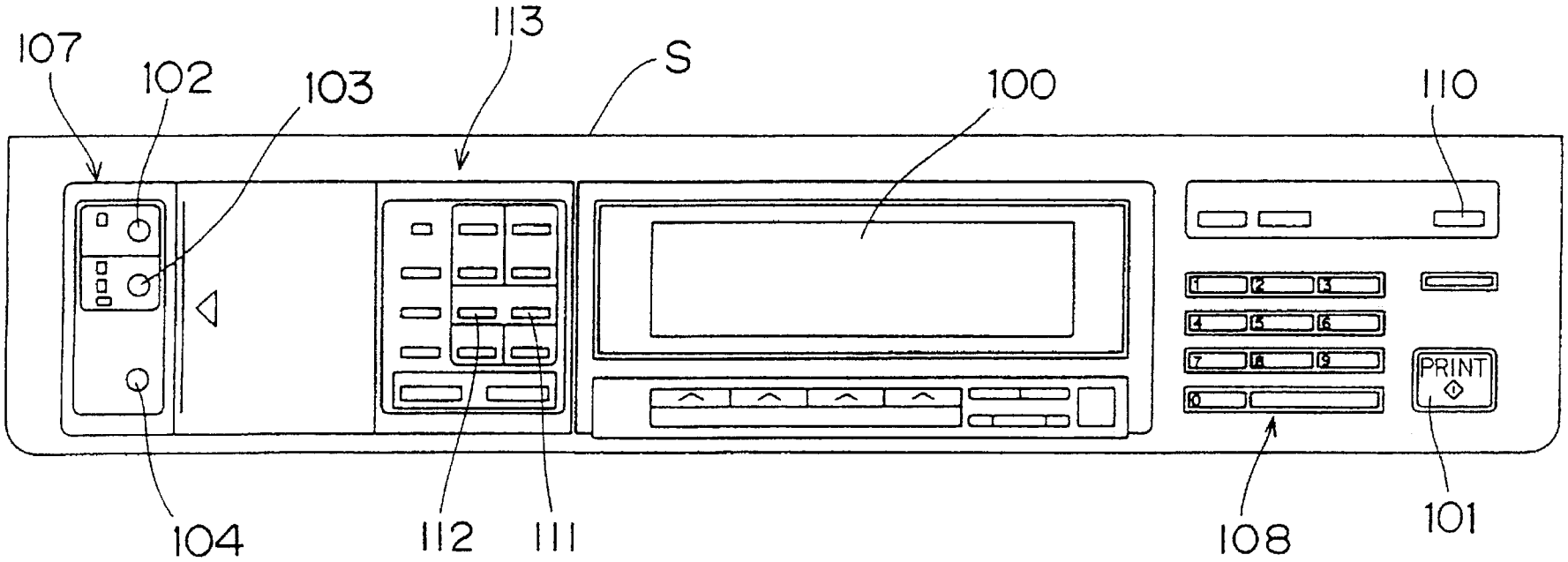
FIG. 3 is a plan view illustrating the external construction of an operation section of the copying machine.

FIG. 3 is a plan view illustrating the external construction of the operation section S of the copying machine. The operation section S has a display section 100 such as of a liquid crystal display device (LCD) disposed in the central portion thereof. On the right side of the display section 100 in FIG. 3 are disposed a print key 101 to be pressed for starting the copying operation.

On the left side of the display section 100 is disposed a first mode setting section 113 including a two-side copy key 111 for setting the two-side copy mode and a separate copy key 112 for setting the separate copy mode. On the left side of the first mode setting section 113 is disposed a second mode setting section 107. The second mode setting section 107 includes a punch key 102 for setting a punch mode for the implementation of the punching process, a staple key 103 for setting a staple mode for the implementation of the staple process, and a sort copy key 104 for setting a sort mode for sorting and discharging copy sheets which have been subjected to the copying operation into the plurality of sort bins T1 to Tm.

On the right side of the display section 100 are disposed ten keys 108 which are used to input the number of copies to be made. Disposed adjacent to the ten keys 108 is an interruption copy key 110. The interruption copy key 110 is used to set an interruption copy mode for interrupting a presently performed copying operation or post-process operation to perform another copying operation.

Figure 4:
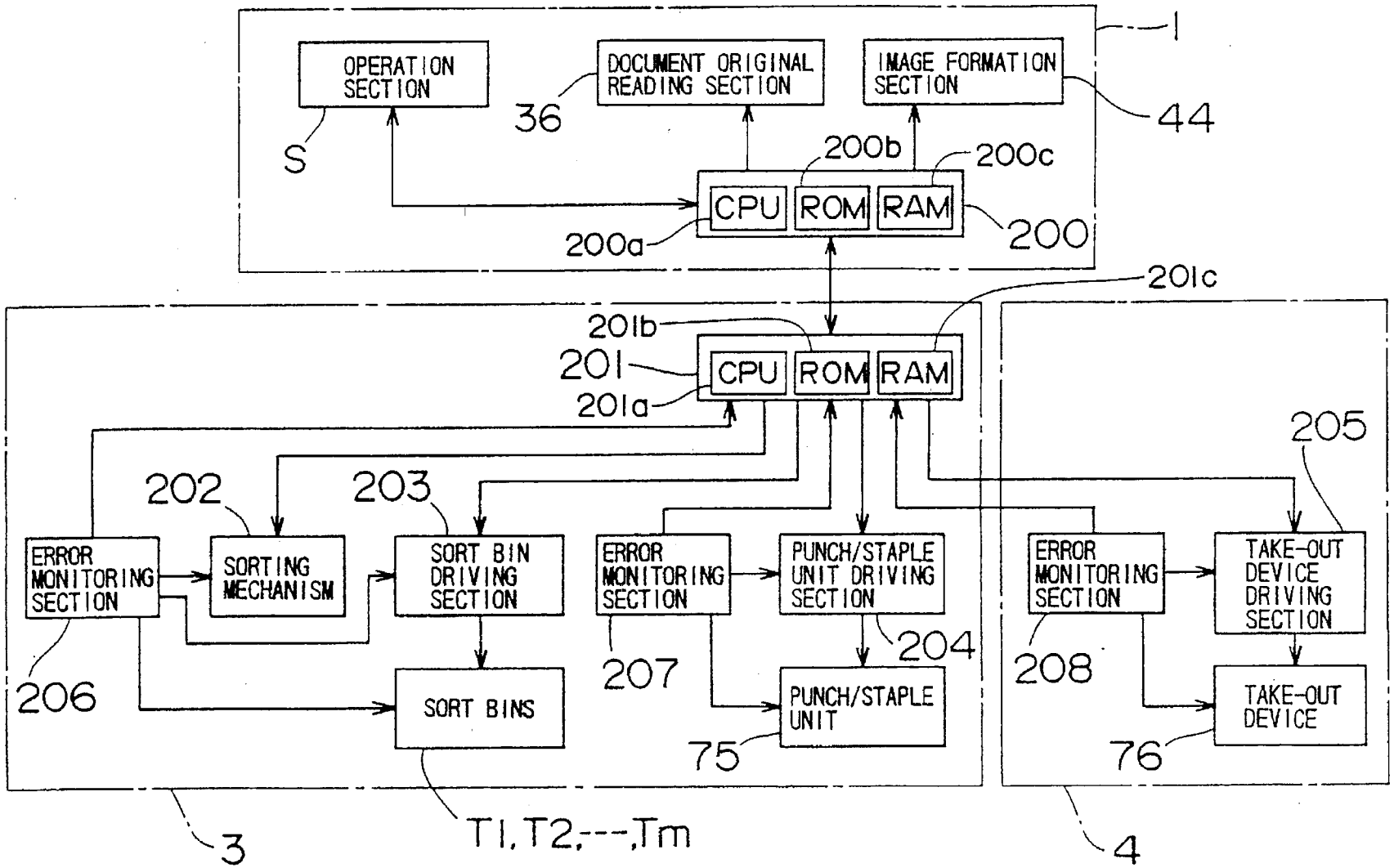
FIG. 4 is a block diagram illustrating the electrical construction of the copying machine, particularly, electrical connection between a copying machine body, a sorter and a stacker of the copying machine.

FIG. 4 is a block diagram illustrating the electrical construction of the copying machine, particularly, electrical connection between the copying machine body 1, the sorter 3 and the stacker 4 of the copying machine.

The copying machine body 1 has a main body controller 200 which comprises a microcomputer including, for example, a CPU 200*a*, a ROM 200*b* and a RAM 200*c*. The main body controller 200 is connected to the operation section S, the document original reading section 36 and the image formation section 44. The main body controller 200 controls the operation section S, the document original reading section 36 and the image formation section 44 based on operational programs stored in the ROM 200*b*.

The sorter 3 has a sorter controller 201 comprising a microcomputer including a CPU 201*a*, a ROM 201*b* and a RAM 201*c*. The sorter controller 201 is connected to the main body controller 200 by which the operation thereof is controlled. The sorter controller 201 is connected to the sorting mechanism 202 for guiding copy sheets which have been subjected to the copying operation into the non-sort bin TN or the plurality of sort bins T1 to Tm, the sort bin driving section 203 for driving the plurality of sort bins T1 to Tm, the punch/staple unit driving section 204 for driving the punch/staple unit 75, and a take-out device driving section 205 for driving the take-out device 76 of the stacker 4. The punch/staple unit driving section 204, the punch/staple unit 75, the take-out device driving section 205 and the take-out device 76 correspond to post-processors. The sorter controller 201 controls the post-processors, the sort bin driving section 203 and the sorting mechanism 202 under the control of the main body controller 200.

Further, the sorter controller 201 is connected to error monitoring sections 206, 207 and 208 for monitoring the respective sections to check if any error occurs therein. The error monitoring section 206 monitors the sorting mechanism 202, the sort bin driving section 203 and the sort bins T1 to Tm to check if any error occurs therein. The error monitoring section 207 monitors the punch/staple unit driving section 204 and the punch/staple unit 75 to check if any error occurs therein. The error monitoring section 208 monitors the take-out device driving section 205 and the take-out device 76 to check if any error occurs therein.

When the error monitoring section 206, 207 or 208 detects the occurrence of an error, the sorter controller 201 outputs an error occurrence signal to the main body controller 200. At this time, error section identification data indicative of which section causes the error and error type identification data indicative of the type of the error are also outputted. Exemplary errors include electrical errors and such an event that a cover of the sort bins T1 to Tm is left open. Upon receiving the error occurrence signal, the main body controller 200 judges whether or not the malfunctioning section should be electrically disconnected. Based on the judgment, the main body controller 200 controls the sorter controller 201.

Figure 5:
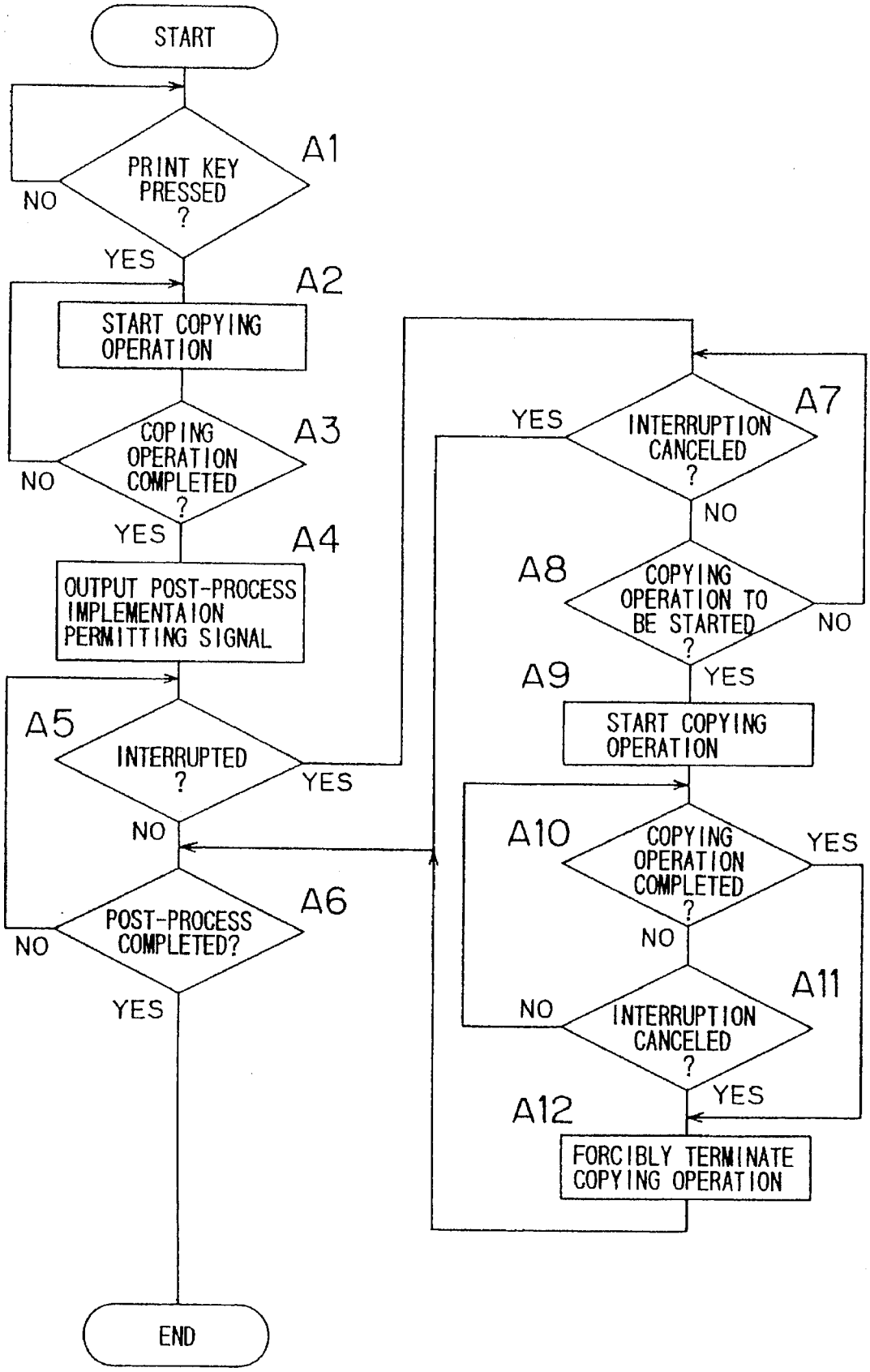
FIG. 5 is a flow chart for explaining a control process to be performed by a main body controller provided in the copying machine body.
Figure 6:
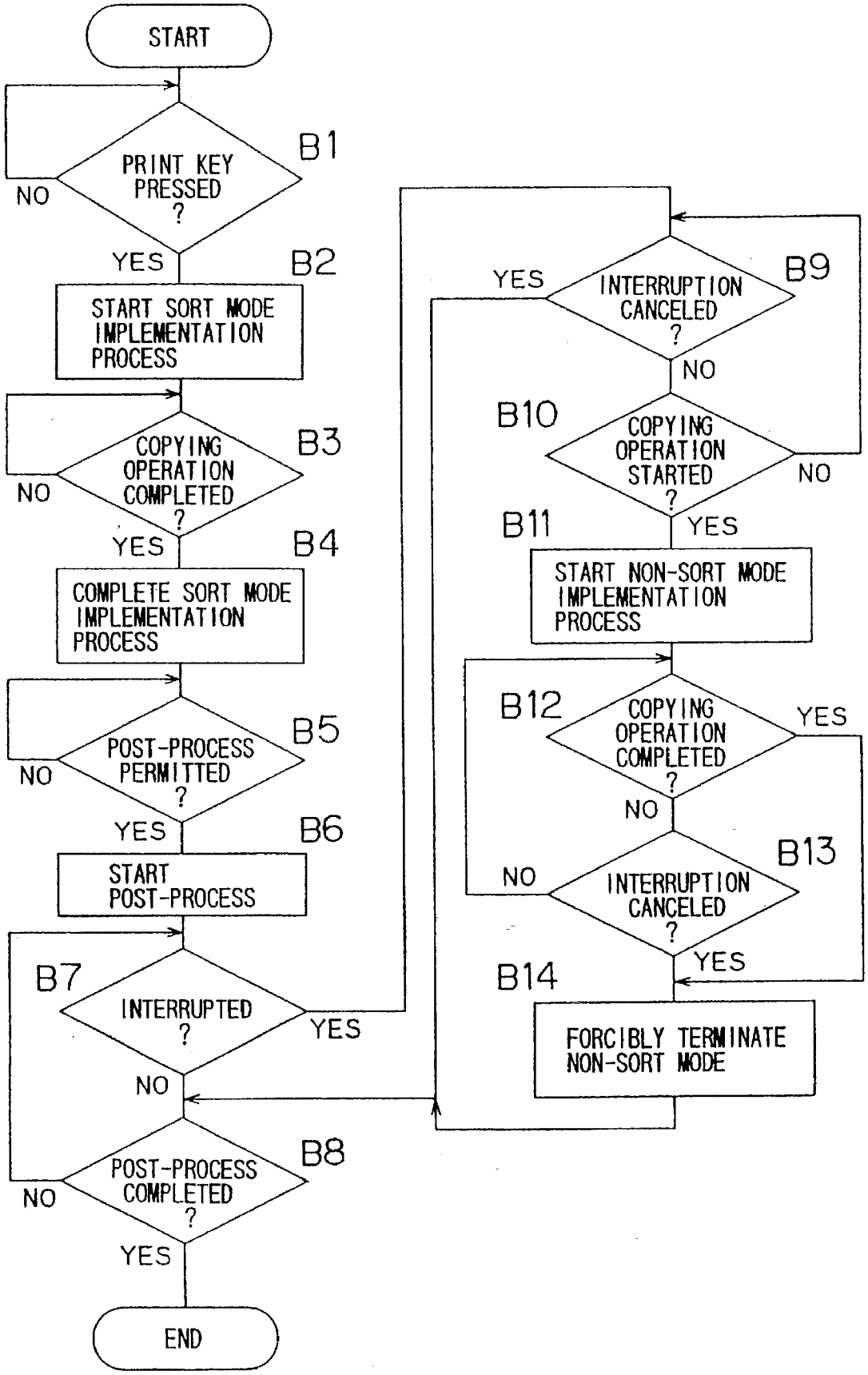
FIG. 6 is a flow chart for explaining a control process to be performed by a sorter controller provided in the sorter.

FIGS. 5 and 6 are flow charts for explaining the operation of the copying machine. FIG. 5 illustrates a control process to be performed in the main body controller 200 by the CPU 200*a* operating based on predetermined programs stored in the ROM 200*b*. FIG. 6 illustrates a control process to be performed in the sorter controller 201 by the CPU 201*a* operating based on predetermined programs stored in the ROM 201*b*. It is assumed in these flow charts that the sort mode is selected as the copy mode, and the staple mode is selected as the post-process mode.

Referring to FIG. 5, when an operator presses the print key 101 to start the copying operation in a state where a plurality of document original sheets are set in the document original setting position 21 of the RDH 2 (Step A1), the main body controller 200 controls a copy operation section including the document original reading section 36 and the image formation section 44, so that the document original sheets are fed one by one and the copying operation is started (Step A2).

Referring to FIG. 6, in response to the pressing of the print key 101 (Step B1), the sorter controller 201 starts controlling the sorting mechanism 202. A sort mode implementation process is performed in which a copy sheet subjected to the copying operation and formed with an image is discharged into any one of the plural sort bins T1 to Tm (Step B2).

Referring to FIG. 5, if it is determined that all the document original sheets set in the document original setting position 21 have been subjected to the copying operation (Step A3), the main body controller 200 outputs to the sorter controller 201 a post-process implementation permitting signal which indicates that the sorter 3 is permitted to perform the post-process (Step A4).

As shown in FIG. 6, the sorter controller 201 completes the sort mode implementation process in response to the completion of the copying operation (Step B3). The sorter controller 201 controls the punch/staple unit 75 and take-out device 76 (which serve as the post-processors) through the punch/staple unit driving section 204 and take-out device driving section 205, respectively, to start performing the post-process in response to the post-process implementation permitting signal (Steps B4 and B5). Since it is herein assumed that the staple mode is selected as the post-process mode as described above, sets of plural copy sheets discharged into the sort bins T1 to Tm are stapled by means of the stapler. Whenever the staple mode is selected, the stack process is automatically implemented. Therefore, the sets of copy sheets stapled by the stapler are stacked in the stack section D.

Referring to FIG. 5, after outputting the post-process implementation permitting signal, the main body controller 200 judges whether or not the interruption copy key 110 is pressed during the post-process to designate the interruption copy mode (Step AS). If it is determined that the interruption copy mode is not designated, the sorter 3 is monitored for checking if the post-process is completed therein (Step A6). The monitoring operation is performed to shift the operation mode of the copying machine to a usual copy stand-by mode after the completion of the post-process.

As shown in FIG. 6, the sorter controller 201 judges whether or not the interruption copy mode is designated after the post-process is started (Step B7). If the interruption mode is not designated, the post-process is continued (Step B8).

If it is determined in Step A5 of FIG. 5 that the interruption copy key 110 is pressed, the main body controller 200 judges whether or not the interruption is canceled (Step A7). If the interruption is canceled, the monitoring operation is continued for checking if the post-process is completed (Step A6). On the other hand, if the interruption is not canceled, the copying operation is started in the interruption mode (Step A9) in response to the pressing of the print key 101 (Step A8).

If the interruption is canceled during the copying operation in the interruption mode (Step All), the main body controller 200 forcibly terminates the copying operation (Step A12), and continues the monitoring operation to check if the post-process is completed (Step A6). If it is determined that the copying operation is completed normally (i.e., without interruption) (Step A10), the main body controller 200 continues the monitoring operation to check if the post-process is completed (Step A6).

If the sorter controller 201 determines based on the signal from the main body controller 200 in Step B7 of FIG. 6 that the interruption copy key 110 is pressed, the sorter controller 201 judges whether or not the interruption is canceled (Step B9). If the interruption is canceled, the sorter controller 201 does not perform a non-sort mode implementation process in Step B11 but controls the punch/staple unit driving section 204 and the take-out device driving section 205 to continue performing the post-process. If it is determined in Step B9 that the interruption is not canceled, the sorter controller 202 controls the sorting mechanism 202 to start the non-sort mode implementation process (Step B11) in response to the pressing of the print key 101 (Step B10). In the non-sort mode implementation process, copy sheets are discharged into the non-sort bin TN which is unlikely to be blocked by the copy sheets presently being subjected to the post-process. The post-process is performed concurrently with the non-sort mode implementation process.

If the interruption is canceled during the non-sort mode implementation process (Step B13), the sorter controller 201 terminates only the non-sort mode implementation process (Step B14). That is, only the post-process, if effected, is continuously performed (Step B8). After the non-sort mode implementation process is completed normally (i.e., without the interruption being canceled), the post-process, if effected, is continuously performed (Step B8).

Although an explanation has been given to the flow charts by taking a case where the staple mode is selected as the post-process mode, the copying machine performs the post-process in substantially the same manner as described above where the punch mode is selected as the post-process mode.

When the interruption copy mode is designated during the implementation of the post-process, the copying machine according to this embodiment performs the non-sort implementation process while continuing the post-process. More specifically, during the post-process, the copy sheet formed with an image through the copying operation in the interruption copy mode is discharged into the non-sort bin TN which is unlikely to be blocked by the copy sheets presently being subjected to the post-process. Therefore, the operator does not have to wait for the completion of the post-process in order to start the next copying operation. This saves time for a copy work, thereby improving the efficiency of the office work.

Figure 7A:
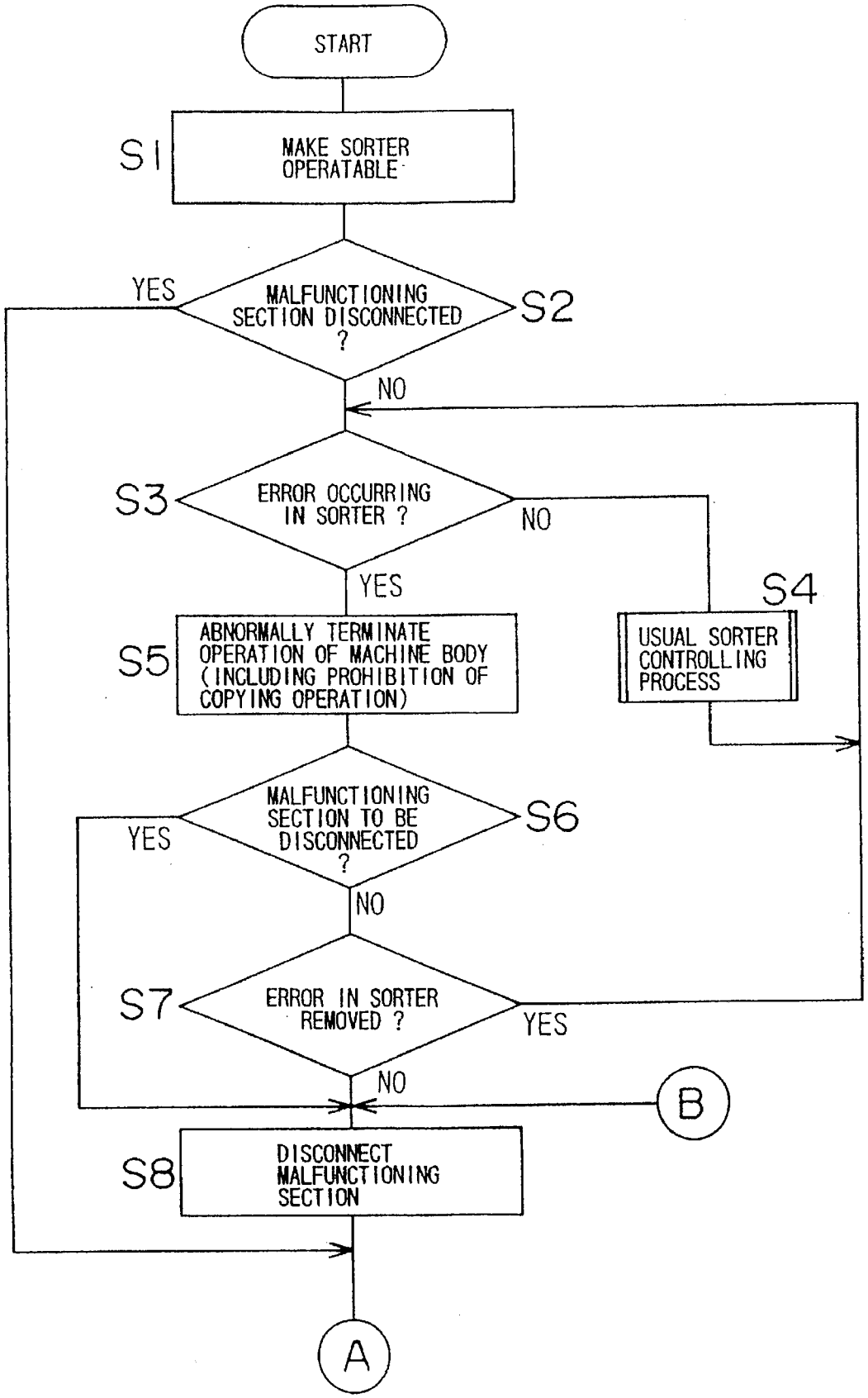
FIGS. 7A and 7B are flow charts for explaining a control process to be performed by the main body controller when an error occurs in any section in the sorter or the stacker.
Figure 7B:
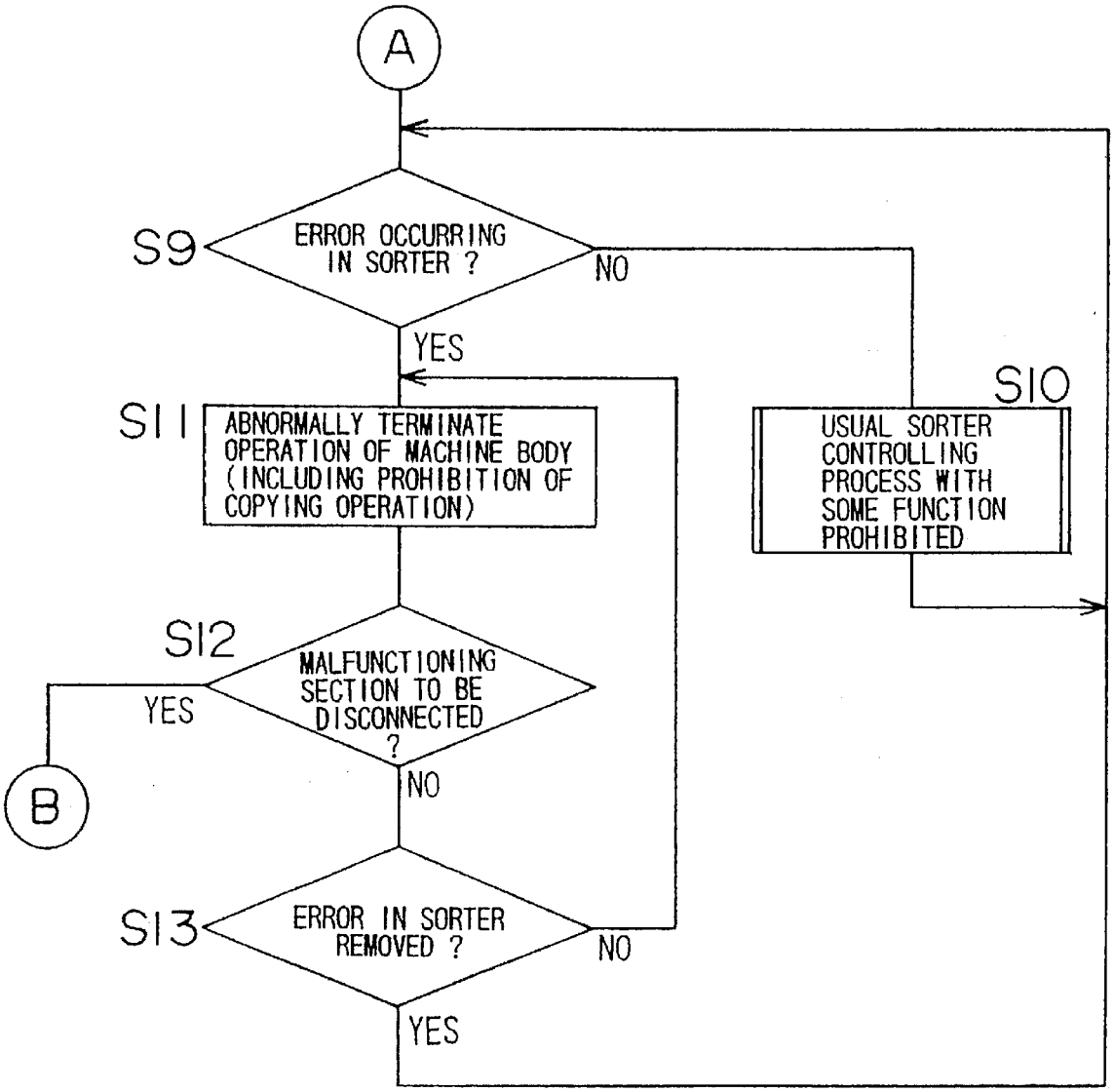
Figure 8:
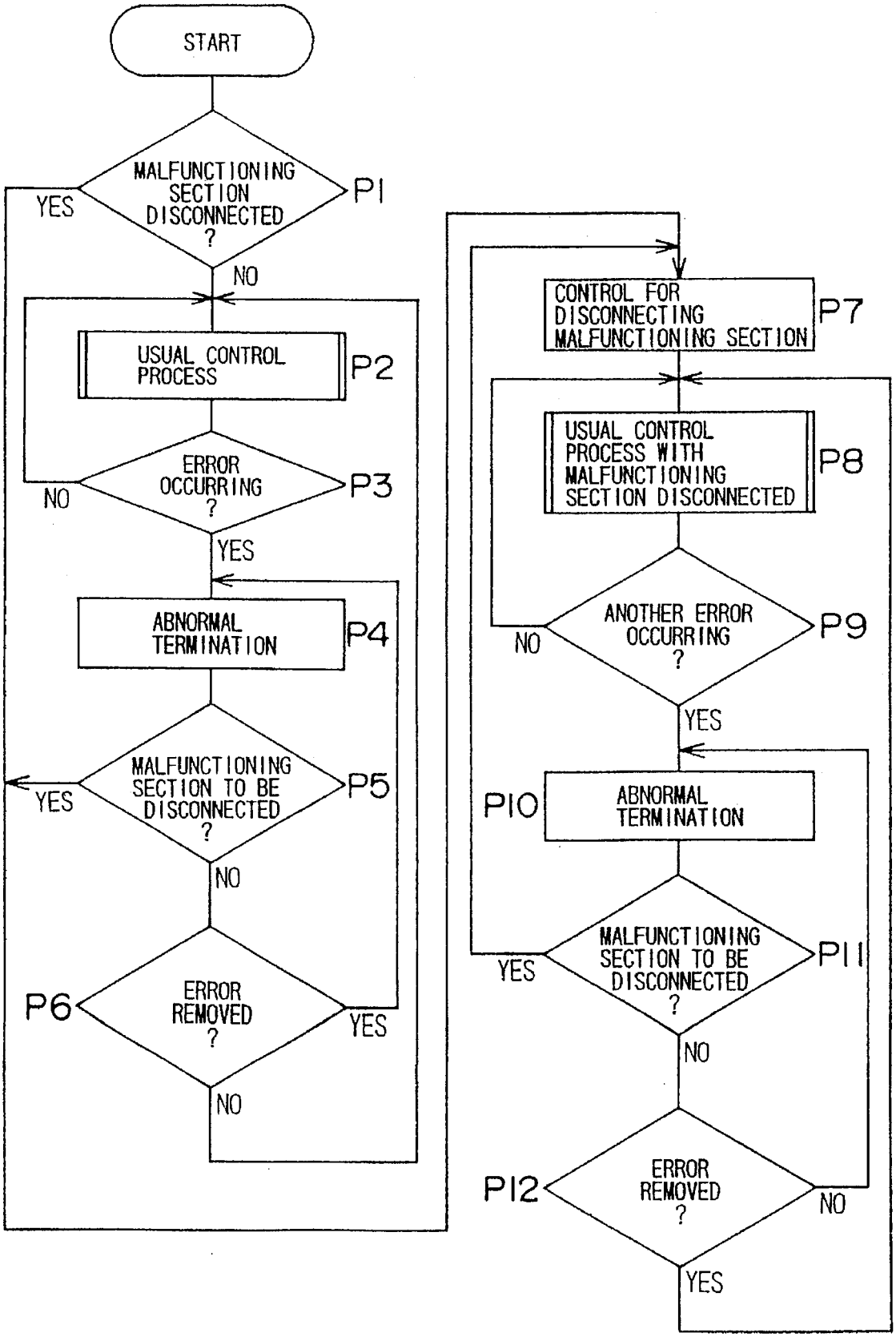
FIG. 8 is a flow chart for explaining a control process to be performed by the sorter controller when an error occurs in any section in the sorter or the stacker.

Referring to FIGS. 7A, 7B and 8, an operation of the copying machine will be described which is to be performed when an error occurs in any section in the sorter 3 or the stacker 4. FIGS. 7A and 7B are flow charts for explaining a sorter controlling process to be performed by the main body controller 200 in the copying machine body 1. The sorter controlling process is performed by the CPU 200*a* operating based on predetermined programs stored in the ROM 200*b*. FIG. 8 is a flow chart for explaining a control operation to be performed by the sorter controller 201 in the sorter 3. This operation is performed by the CPU 201*a* operating based on predetermined programs stored in the ROM 201*b*.

Referring to FIG. 7A, after a power supply (not shown) to the copying machine is turned on to energize the copying machine, the main body controller 200 causes the sorter 3 operatable (Step S1). More specifically, the main body controller 200 applies a reset signal to the sorter controller 201 after it is energized, and then stops applying the reset signal to cause the sorter 3 operatable. The main body controller 200 then judges whether or not a section which has caused a critical error in the previous copying operations is electrically disconnected (Step S2). If it is determined that the section is disconnected, a sorter controlling process is performed which is designed for a case where the malfunctioning section has been disconnected (which will be described later). On the other hand, if it is determined that there is no section which caused an error in the previous copying operations, it is judged whether or not any error occurs in the sorter 3 or stacker 4 (Step S3). More specifically, the occurrence of the error is detected based on an error occurrence signal outputted from the sorter controller 201. If it is determined that the sorter controller 201 does not output an error occurrence signal, a usual sorter controlling process is performed in a mode selected by the operator (Step S4).

Referring to FIG. 8, the sorter controller 201 makes the sorter 3 operatable, and then judges whether or not a section which caused an error in the previous copying operations is electrically disconnected (Step P1). If it is determined that the malfunctioning section has been disconnected, a control operation is performed in accordance with the process designed for the case where the malfunctioning section has been disconnected (which will be described in detail later). On the other hand, if it is determined that there is no section which has caused an error in the previous copying operations, a control operation corresponding to the process of Step S4 of FIG. 7A is performed (Step P2). If it is determined in the error monitoring section 206, 207 or 208 during this control operation that an error occurs in any section (Step P3), the sorter controller 201 once abnormally terminates the controlling operation of Step P2 (Step P4), and outputs an error occurrence signal along with error section identification data and error type identification data. The sorter controller 201 waits for a judgment on whether or not the malfunctioning section should be disconnected, the result of which judgment is to be applied thereto from the main body controller 200 (Step P5).

As shown in FIG. 7A, upon receiving the error occurrence signal (Step S3), the main body controller 200 once abnormally terminates the operations of the copying machine body 1 including the copying operation (Step S5). Then, the main body controller 200 judges based on the error type identification data whether or not the error is critical so that malfunctioning section should be disconnected (Step S6). If it is determined that the error is noncritical so that there is no need to electrically disconnect the malfunctioning section, it is judged whether or not the sorter 3 has recovered from the error (Step S7). The noncritical error not requiring the electrical disconnection of a malfunctioning section includes such an event that the cover of the sort bins is left open. When the noncritical error has been removed (Step S7), the process enters Step S3 to resume the sorter controlling process.

If it is determined in Step S6 that the malfunctioning section should be electrically disconnected, the main body controller 200 applies to the sorter controller 201 an instruction to electrically disconnect the malfunctioning section (Step S8). Where an electrical error occurs in the punch/staple unit driving section 204, for example, the main body controller 200 applies to the sorter controller 201 an instruction to electrically disconnect the punch/staple unit driving section 204 from the sorter controller 201.

As shown in FIG. 8, upon receiving the instruction that the malfunctioning section does not have to be electrically disconnected, the sorter controller 201 judges whether or not the error has been removed (Step P6). If it is determined that the error has been removed, the process enters Step P2 to resume the control operations of the respective sections of the sorter 3. On the other hand, if the main body controller 200 applies to the sorter controller 201 the instruction to electrically disconnect the malfunctioning section, the malfunctioning section is electrically disconnected (Step P7). Thereafter, the sorter controlling process is performed with the malfunctioning section electrically disconnected (Step P8). Where a critical error occurs in the punch/staple unit driving section 204, for example, the process for discharging copy sheets into the non-sort bin TN or the control operation of the sorting mechanism in the sort mode 202 is performed as usual, while the punching process or stapling process in the punch/staple unit 75 is prohibited.

Where it is determined in any of the error monitoring sections 206, 207 and 208 that an error occurs in another section while the control operation is performed with the malfunctioning section disconnected (Step P9), the sorter controller 201 performs the same processes as in Steps P4 and P5. More specifically, the sorter controller 201 once abnormally terminates the control operation (Step P10). Then, the sorter controller 201 outputs to the main body controller 200 an error occurrence signal along with error section identification data and error type identification data, and waits for an instruction on whether or not the malfunctioning section should be electrically disconnected (Step P11).

AS shown in FIG. 7B, the main body controller 200 performs the sorter controlling process in a state where the section which has caused the critical error is electrically disconnected (Step S10), until an error occurrence signal indicative of the occurrence of an error in another section is applied thereto from the sorter controller 201 (Step S9). Where the punch/staple unit driving section 204 is electrically disconnected, for example, the original image reading section 36 and the image formation section 44 are controlled to prohibit the copying operation in the punch mode and in the staple mode while permitting the copying operation in the other modes such as the sort mode.

At this time, a message such as "PUNCH/STAPLE MODE NOT AVAILABLE" is preferably displayed in the display section 100. This allows the operator to readily recognize the malfunctioning section, so that the malfunctioning section can be repaired promptly.

If it is determined in Step S9 that another error occurs, the same processes as in Steps S5 and S6 are carried out. More specifically, the operations of the copying machine body 1 including the copying operation are once abnormally terminated (Step S11), and it is judged on the basis of the error type identification data whether or not the error is a critical one requiring the electrical disconnection of the malfunctioning section (Step S12). If it is determined that the malfunctioning section does not have to be electrically disconnected, it is judged whether or not the error has been removed (Step S13). If it is determined that the error has been removed, the process enters Step S10 to resume the sorter controlling operation. On the other hand, it is determined in Step S12 that the malfunctioning section should be electrically disconnected, the process enters Step S8. The main body controller 200 instructs the sorter controller 201 to electrically disconnect the malfunctioning section, and resumes the sorter controlling process.

Referring to FIG. 8, upon receiving from the main body controller 200 an instruction that the malfunctioning section does not have to be electrically disconnected (Step P11), the sorter controller 201 waits for the error to be removed (Step P12). When the error is removed, the process enters Step P8, and the control operation is resumed in a state where the section which has caused the critical error is electrically disconnected. On the other hand, if the sorter controller 201 receives from the main body controller 200 an instruction to electrically disconnect the malfunctioning section (Step P11), the process enters Step P7. The sorter controller 201 electrically disconnects the malfunctioning section and resumes the control operation.

As described above, when an error occurs in any section in the sorter 3 or the stacker 4, the copying machine according to this embodiment electrically disconnects the malfunctioning section. Thereafter, the copying machine can perform the copying operation by using normal sections other than the malfunctioning section electrically disconnected. This eliminates an inconvenience such that the copying operation cannot be performed until the malfunctioning section recovers from the error. Even where the copying machine is used in a rural area such that a user may have to wait for a long time for a technical service person to come to repair the copying machine, for example, the retardation of the user's office work due to the malfunction of the copying machine can be minimized.

EMBODIMENT 2

Figure 9:
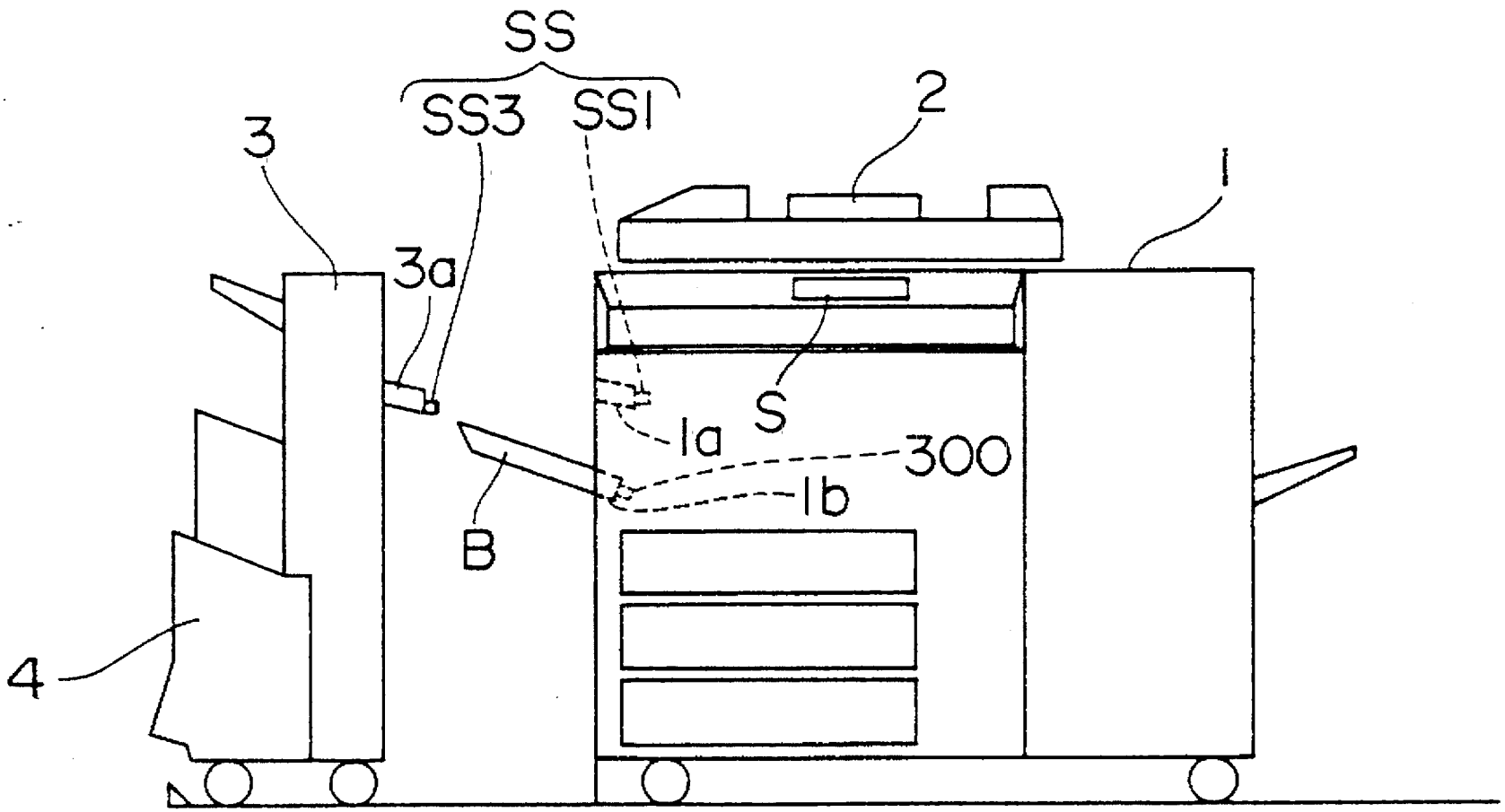
FIG. 9 is a schematic diagram illustrating the external construction of a copying machine in accordance with a second embodiment of the present invention, in which the sorter can physically be disconnected from the copying machine body.

FIG. 9 is a front view illustrating the external construction of a copying machine in accordance with a second embodiment of the present invention, in which the sorter 3 can be physically disconnected from the copying machine body 1. Unlike the first embodiment of the present invention in which the copying operation is permitted in a state where the sorter 3 is physically connected to the copying machine body 1 but the malfunctioning section of the sorter 3 is electrically disconnected from the copying machine body 1, the copying machine of the second embodiment permits the copying operation upon condition that the sorter 3 including a malfunctioning section has physically been disconnected from the copying machine body 1. To describe this embodiment, reference is also made to FIGS. 2, 3 and 4.

The sorter 3 can be physically disconnected from the copying machine body 1 as shown in FIG. 9. The sorter 3 is usually combined with the copying machine body 1 by fitting a projection 3*a* of the sorter 3 into a recess 1*a* of the copying machine body 1. The recess la and the projection 3*a* serve as engagement members, and respectively include electrical contacts SS1 and SS3. More specifically, the recess 1*a* and the projection 3*a* function as a set switch SS for detecting the engagement of the sorter 3 with the copying machine body 1. Therefore, whether or not the sorter 3 is physically disconnected from the copying machine body 1 is judged by monitoring the state of the set switch SS.

The copying machine body 1 has an attachment portion 1*b* provided on a surface thereof facing opposite the sorter 3, to which attachment portion 1*b* an operator can manually attach a discharge tray B. The discharge tray B serves in place of the sorter 3 to receive copy sheets when the sorter 3 is disconnected from the copying machine body 1. The attachment of the discharge tray B to the attachment portion 1*b* is detected based on an output of the attachment detection switch 300.

Figure 10A:
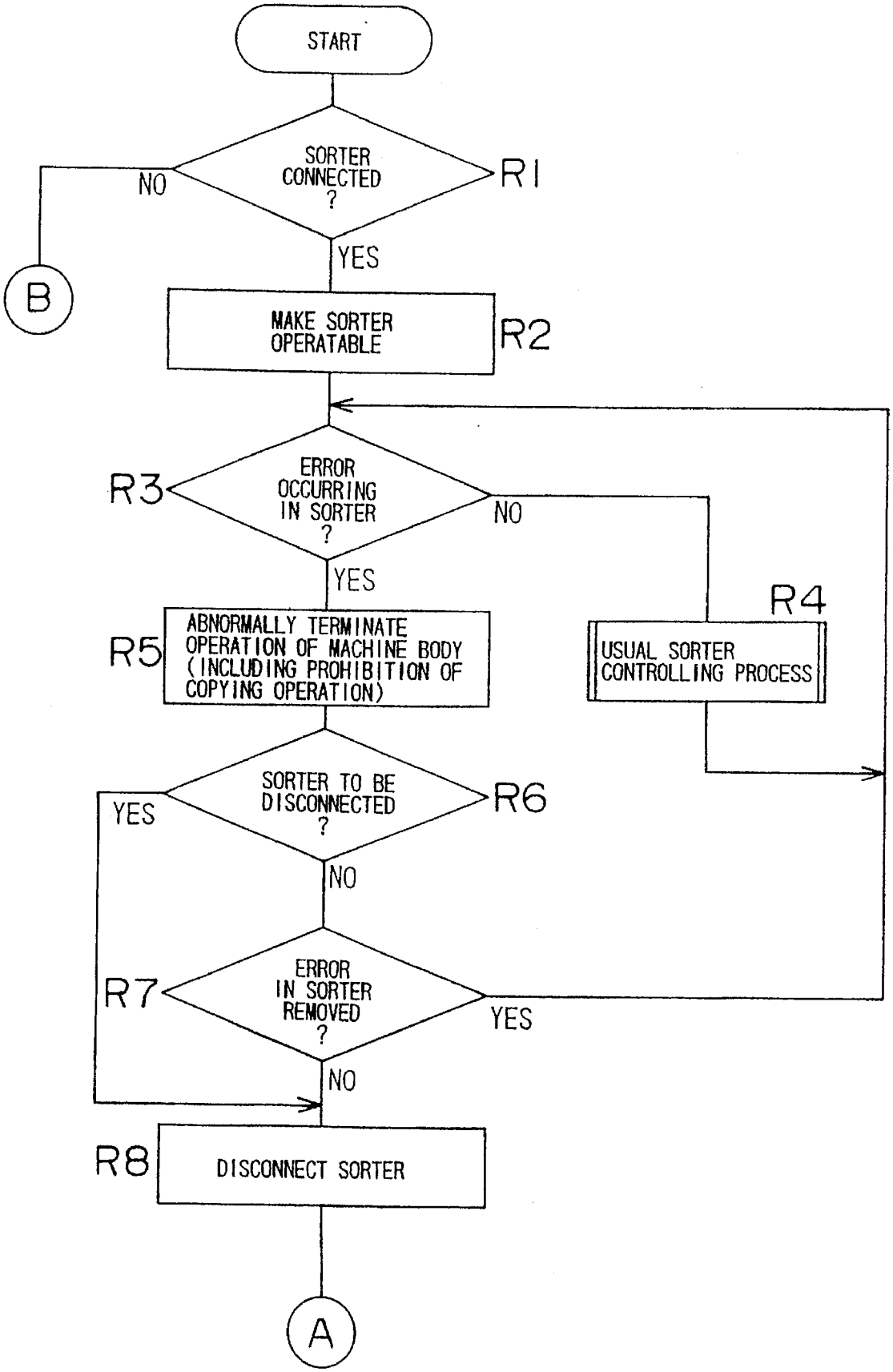
FIGS. 10A and 10B are flow charts for explaining a sorter controlling process to be performed by the main body controller when an error occurs in any section in the sorter or the stacker.
Figure 10B:
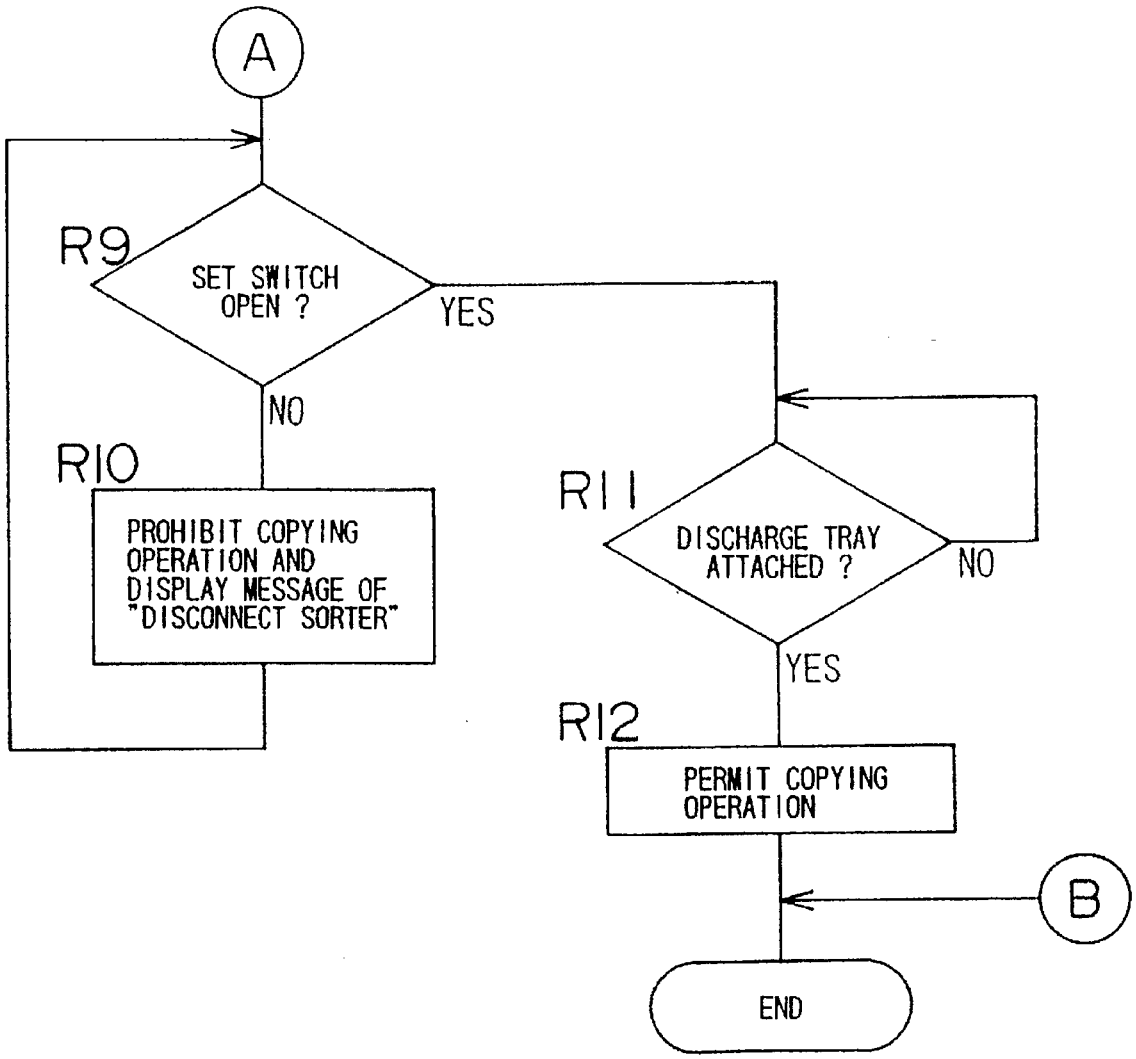
Figure 11:
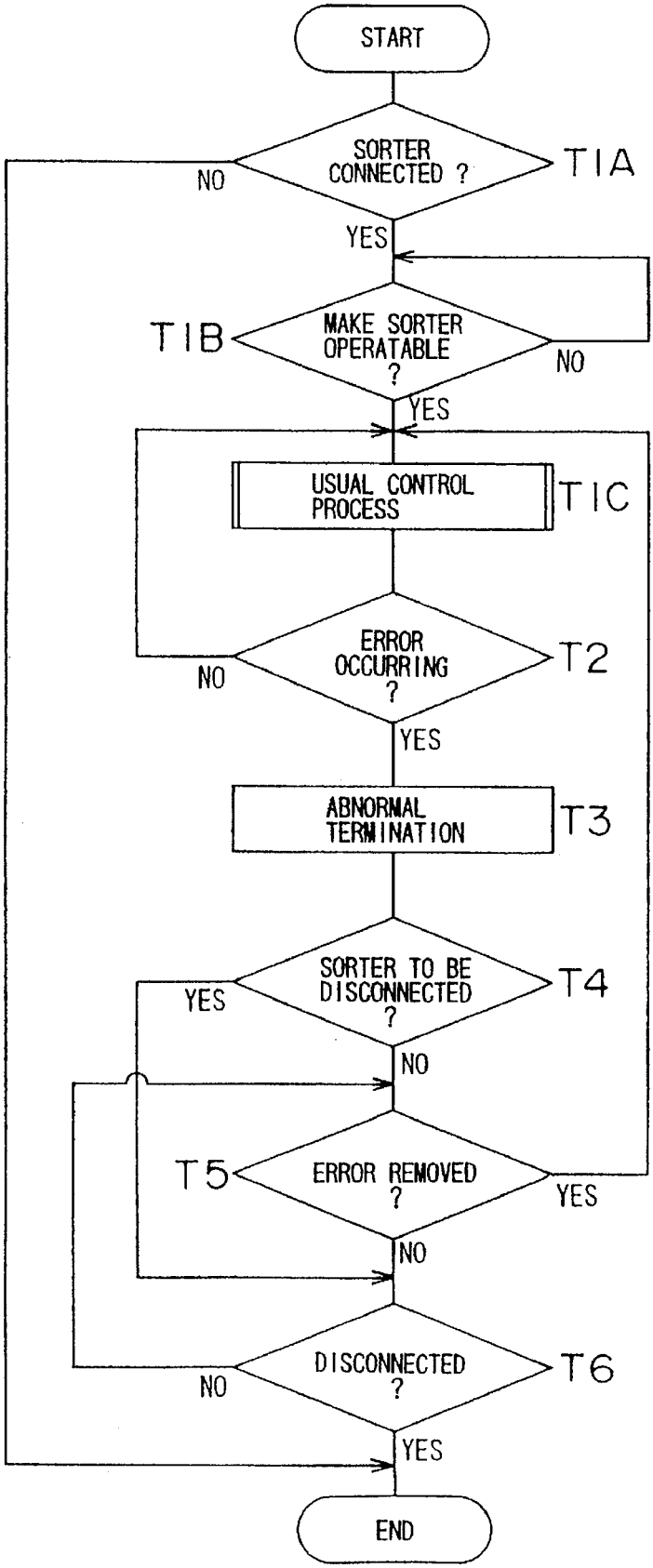
FIG. 11 is a flow chart for explaining the control process to be performed by the sorter controller when an error occurs in any section in the sorter or the stacker.

FIGS. 10A, 10B and 11 are flow charts for explaining an operation of the copying machine according to the second embodiment, particularly, an operation to be performed when an error occurs in any section in the sorter 3 or the stacker 4. In particular, FIGS. 10A and 10B are flow charts for explaining a sorter controlling process to be performed by the main body controller 200 in the copying machine body 1. The sorter controlling process is performed by the CPU 200*a* operating based on predetermined programs stored in the ROM 200*b*. FIG. 11 is a flow chart for explaining a control process to be performed by the sorter controller 201 in the sorter 3. The control process is performed by the CPU 201*a* operating based on predetermined programs stored in the ROM 201*b*.

Referring to FIG. 10A, after the power supply (not shown) to the copying machine is turned on to energize the copying machine, the main body controller 200 judges based on the state of the set switch SS whether or not the sorter 3 is connected to the copying machine body 1 (Step R1). If the sorter 3 is connected to the copying machine body 1, the sorter 3 is made operatable (Step R2). Thereafter, it is judged based on an error occurrence signal from the sorter controller 201 whether or not an error occurs in the sorter 3 (Step R3). If no error occurs in the sorter 3, the sorter controlling process is performed as usual in a mode selected by an operator (Step R4).

Referring to FIG. 11, the sorter controller 201 judges on the basis of the state of the set switch SS whether or not the sorter 3 is connected to the copying machine body 1 (Step T1A). If the sorter 3 is connected to the copying machine body 1, the sorter controller 201 waits for the completion of the process of Step R2 of FIG. 10A (Step T1B), and then performs the usual control process (Step T1C).

If it is determined in the error monitoring section 206, 207 or 208 that an error occurs in any section in the sorter 3 or the stacker 4 (Step T2), the sorter controller 201 once abnormally terminates the control process of Step T1C (Step T3). Then, the sorter controller 201 outputs an error occurrence signal, error type identification data and error section identification data to the copying machine body 1. Subsequently, the sorter controller 201 waits for an instruction on whether or not the sorter 3 should be disconnected from the copying machine body 1, which instruction is to be applied from the main body controller 200 (Step T4). If the main body controller 200 applies to the sorter controller 201 an instruction indicating that there is no need to disconnect the malfunctioning section, the sorter controller 201 waits for the error to be removed (Step T5), and then the process enters Step T1C to resume the control operation. On the other hand, if an instruction to disconnect the malfunctioning section is applied to the sorter controller 201, the sorter controller 5 monitors the state of the set switch SS and waits for the sorter 3 to be disconnected from the copying machine body 1 (Step T6).

As shown in FIG. 10A, if it is determined that an error occurs in the sorter 3 (Step R3), the main body controller 200 once abnormally terminates the operation of the copying machine (Step R5). Then, the main body controller 200 judges on the basis of the error type identification data outputted along with the error occurrence signal from the sorter controller 201 whether or not the sorter 3 should be disconnected from the copying machine body 1 (Step R6). If it is determined that there is no need to disconnect the sorter 3, the main body controller 200 waits for the error to be removed (Step R7), and then the process enters Step R3 to resume the sorter controlling process.

On the other hand, if it is judged that the sorter 3 should be disconnected, the main body controller 200 informs the sorter controller 201 of this judgment (Step R8). Then, the main body controller 200 judges on the basis of the state of the set switch SS whether or not the sorter 3 is disconnected from the copying machine body 1 (Step R9 in FIG. 10B). If the sorter 3 is not disconnected from the copying machine body 1, a message of "ERROR IN SORTER. DISCONNECT SORTER." and a diagram indicative of an error type are displayed in the display section 100 (Step R10). Thus, the operator is prompted to disconnect the sorter 3 from the copying machine body 1. At this time, the copying operation is kept unable.

Figures 12A, 12B:
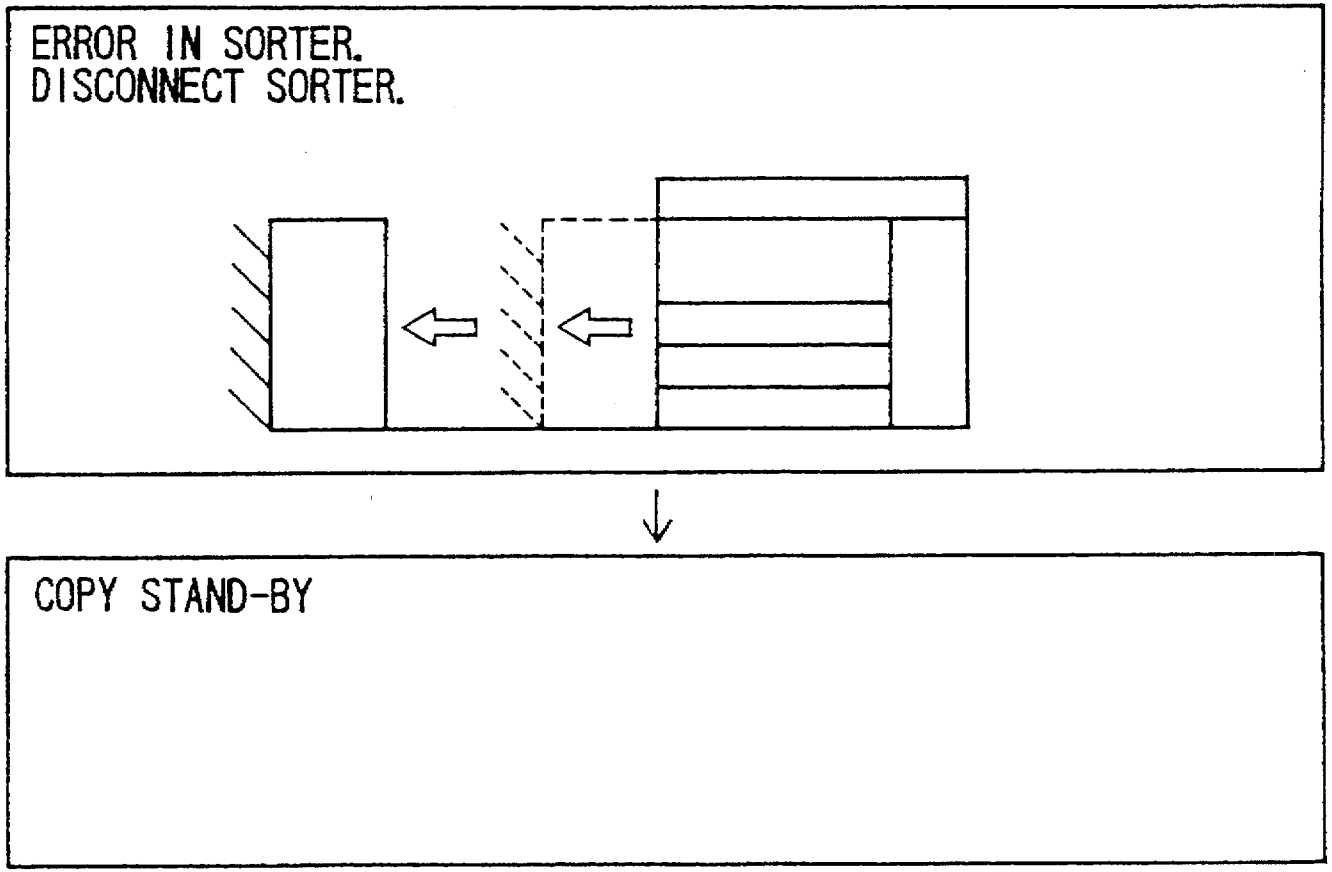
FIGS. 12A and 12B are diagrams illustrating screen images to be displayed in a display section when the sorter is out of order in the copying machine according to the second embodiment.

If it is determined that the set switch SS is open so that the sorter 3 is disconnected from the copying machine body 1, the main body controller 200 judges on the basis of an output from the attachment detection switch 300 whether or not the discharge tray B is attached to the attachment portion 1*b* (Step R11). If the copying operation is performed in a state where the discharge tray B is not attached after the sorter 3 is disconnected from the copying machine body 1, such an inconvenience that copy sheets obtained through the copying operation scatter around on a floor would occur. If it is determined that the discharge tray B is attached to the attachment portion 1*b*, the implementation of the copying operation is permitted (Step R12). The display section 100 is controlled by the main body controller 200 to display a message of "COPY STAND-BY" as shown in FIG. 12B. Thus, the operator is informed that the copying machine is in a copy stand-by state.

As described above, where an error occurs in any section in the sorter 3 or the stacker 4, the copying machine according to the second embodiment is brought into the copy stand-by state upon condition that the sorter 3 has been disconnected from the copying machine body 1 and the discharge tray B has been attached to the attachment portion 1*b*. Therefore, such an inconvenience that copy sheets are discharged into the malfunctioning sorter 3 by mistake can be avoided, and the occurrence of a jam can be assuredly prevented.

Further, the attachment of the discharge tray B to the attachment portion 1*b* is one of the conditions permitting the copying machine to be brought into the copy stand-by state. This prevents the operator from forgetting to attach the discharge tray B to the attachment portion 1*b*, thereby eliminating such an inconvenience that copy sheets scatter around on a floor.

EMBODIMENT 3

There will next be explained a copying machine according to a third embodiment. In the following explanation, reference is also made to FIGS. 2, 4 and 7B.

The copying machine according to the third embodiment is constructed such that the sort bins T1 to Tm, punch/staple unit 75 and stacker 4 in the sorter 3 can be selectively disconnected. More specifically, segmental functional sections can be disconnected from the sorter 3, unlike the second embodiment in which the sorter 3 itself can be disconnected from the copying machine body 1. The copying machine is brought into the copy stand-by state upon condition that a malfunctioning functional section is disconnected from the sorter 3.

More specifically, the main body controller 200 identifies the malfunctioning functional section on the basis of the error section identification data outputted from the sorter controller 201. The main body controller 200 judges on the basis of the error type identification data applied from the sorter controller 201 whether or not the error occurring in the functional section identified by the error section identification data is a noncritical one which can be readily removed. If the error is a critical one which cannot be readily removed, the main body controller 200 displays in the display section 100 of the operation section S a message indicating that the malfunctioning functional section should be disconnected. Upon condition that the functional section suffering the unrecoverable critical error is disconnected through the control operations by the main body controller 200 and the sorter controller 201, the operations of the other normal sections and the copying operation are permitted.

Figure 13:
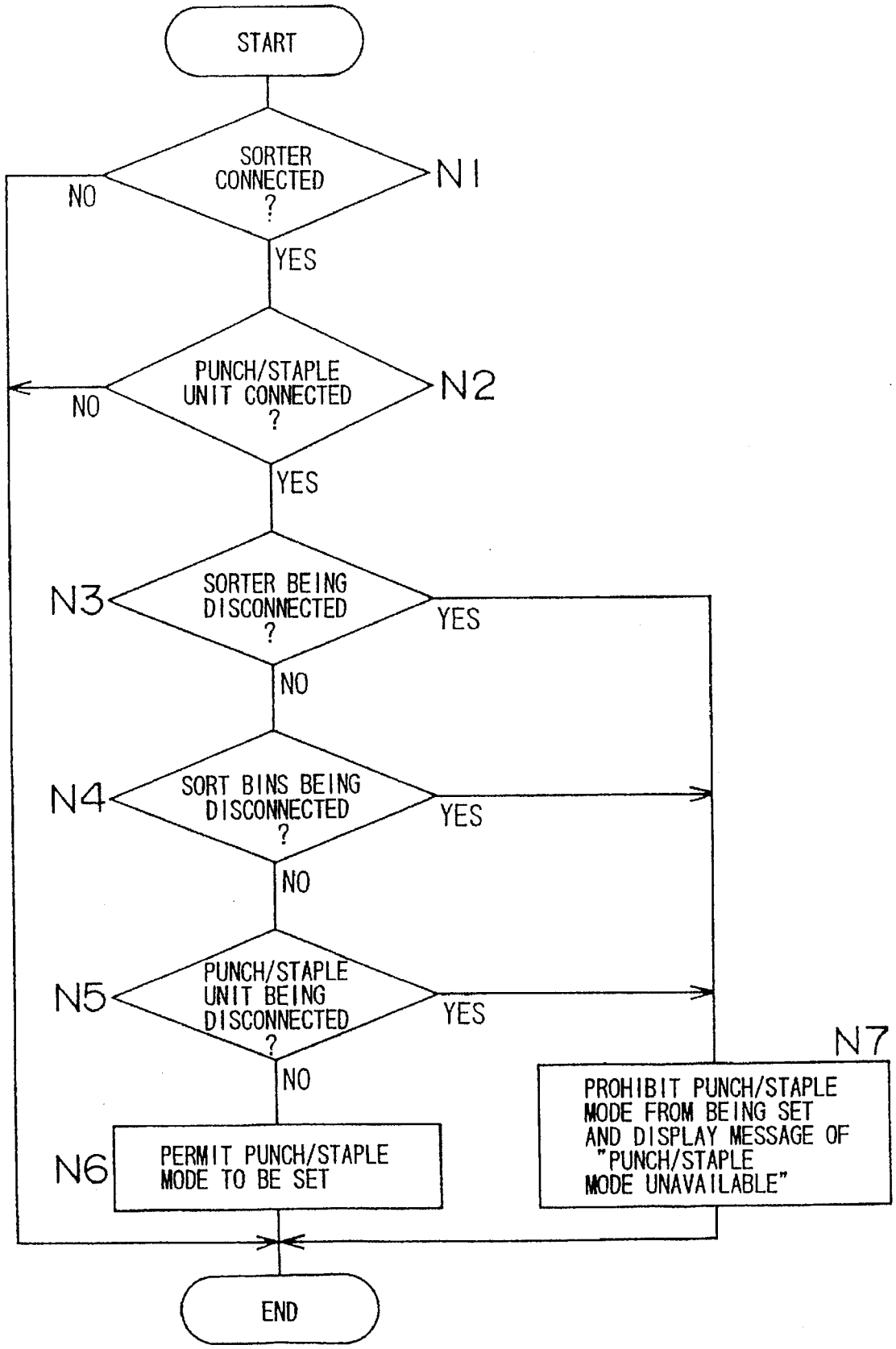
FIG. 13 is a flow chart for explaining a control process to be performed by the main body controller when a punch/staple mode is set in the copying machine in accordance with a third embodiment of the present invention.

FIG. 13 is a flow chart for explaining a control process to be performed by the main body controller 200 when a punch/staple mode is designated in the copying machine of the third embodiment.

The main body controller 200 judges on the basis of the state of the set switch SS whether or not the sorter 3 is connected to the copying machine body 1 (Step N1). If it is determined that the sorter 3 is connected to the copying machine body 1, it is judged whether or not the punch/staple unit 75 is connected to the sorter 3 (Step N2). The detection of the connection of the punch/staple unit 75 may be achieved by employing substantially the same construction as the aforesaid set switch SS. If it is determined that the punch/staple unit 75 is connected to the sorter 3, it is judged whether or not the sorter 3 including the punch/staple unit 75 is being disconnected from the copying machine body 1 (Step N3). If it is determined that the sorter 3 is being disconnected, a message of "PUNCH/STAPLE MODE UNAVAILABLE" is displayed in the display section 100 (Step N7) to inform an operator that the punch/staple mode is not available. On the other hand, if it is determined that the sorter 3 is not being disconnected, it is judged whether or not the sort bins T1 to Tm for receiving copy sheets to be subjected to the punch/staple process are being disconnected (Step N4). If it is determined that the sort bins T1 to Tm are disconnected, the process enters Step N7, and the operator is informed that the punch/staple mode is not available. On the other hand, if the sort bins T1 to Tm are not being disconnected, it is judged whether or not the punch/staple unit 75 itself is being disconnected (Step N5). If the punch/staple unit 75 is not being disconnected, the operator is permitted to designate the punch/staple mode (Step N6). If it is determined that the punch/staple unit 75 is being disconnected, the process of Step N7 is performed.

Described herein is the control operation to be performed in the punch/staple mode by the main body controller 200. The control operation in the sort mode may be performed in substantially the same manner as in the punch/staple mode. More specifically, in the control operation for the sort mode, the judging process of Step N2 is replaced with "THE SORT BINS T1 to Tm CONNECTED?", the process of Step N5 is omitted, and "PUNCH/STAPLE MODE" in Steps N6 and N7 is replaced with "SORT MODE" in the flow chart of FIG. 13.

As described above, where an error occurs in any section in the sorter 3 or the stacker 4, the copying machine according to the third embodiment physically disconnects the malfunctioning section and performs the copying operation by using the other normal sections. Since the copying machine is brought into a copy stand-by state after a segmental functional section is disconnected as a disconnection unit which is smaller than that in the second embodiment, the copying operation can be performed in a state closer to the normal state than in the second embodiment even after the error occurs.

While the embodiments of the present invention have been described, it should be understood that the present invention is not limited to the aforesaid embodiments. For example, although the aforesaid embodiments employ copying machines to explain the present invention, the present invention can be applied to a laser printer and other image forming apparatuses with sorters.

Although the present invention has been described in detail by way of the embodiments thereof, it should be understood that the foregoing disclosure is merely illustrative of the technical principles of the present invention but not limitative of the same. The spirit and scope of the present invention are to be limited only by the appended claims.

What is claimed is:

1. An image forming apparatus comprising:

image forming means for forming an image on a sheet;

a sorter which includes first and second sheet receiving portions for receiving sheets each formed with an image and post-processing means for performing a post-process on a sheet received by the second sheet receiving portion;

interruption mode setting means for designating an interruption mode; and control means for, when the interruption mode is designated by the interruption mode setting means during the post-process performed by the post-processing means, permitting the image forming means to perform image formation and controlling the sorter so that sheets each formed with an image are received by the first sheet receiving portion, while permitting the post-processing means to continuously perform the post-process, and the first sheet receiving portion includes a non-sort bin which is used when sheets each formed with an image are not to be sorted; and the second sheet receiving portion includes a plurality of sort bins which are used When sheets each formed with an image are to be sorted.

2. An image forming apparatus as set forth in claim 1, wherein the post-processing means includes stapling means for stapling a plurality of sheets each formed with an image.

3. An image forming apparatus as set forth in claim 1, wherein the post-processing means includes punching means for punching a sheet formed with an image.

4. An image forming apparatus as set forth in claim 1, wherein the post-processing means includes take-out means for taking out sheets each formed with an image to stack the sheets in a predetermined stack section.

5. An image forming apparatus as set forth in claim 1, further comprising means for vertically moving for adjusting vertical positioning of said plurality of sort bins.

6. An image forming apparatus as set forth in claim 5, wherein said post-processing means includes a punch/staple unit and said means for vertically moving adjusts said plurality of sort bins such that one-by-one said plurality of sort bins are aligned with said punch/staple unit.

7. An image forming apparatus comprising:

image forming means for forming an image on a sheet;

processing means for performing a predetermined process on a sheet formed with an image:

error informing means for outputting an error occurrence signal when an error occurs in the processing means;

control means for prohibiting the processing means from performing the predetermined process and permitting the image forming means to perform image formation in response to the error occurrence signal outputted from the error informing means, and wherein the processing means includes a plurality of functional sections for performing different operations on a sheet formed with an image;

the image forming apparatus further comprising means for outputting error section identification data indicative of which functional section causes an error; and wherein the control means prohibits the functional section specified by the error section identification data from performing the operation thereof, while permitting the other normal functional sections to perform their respective operations.

8. An image forming apparatus as set forth in claim 7, wherein the processing means includes a sorting mechanism for sorting and discharging a plurality of sheets each formed with an image into a plurality of bins.

9. An image forming apparatus as set forth in claim 8, further comprising:

a sorter including a non-sort bin, a plurality of sort bins, and the sorting mechanism; and means for forcibly discharging into the non-sort bin a sheet formed with an image by the image forming means if an error occurs in the sorting mechanism.

10. An image forming apparatus as set forth in claim 7, wherein the processing means includes stapling means for stapling a plurality of sheets each formed with an image.

11. An image forming apparatus as set forth in claim 7, wherein the processing means includes punching means for punching a sheet formed with an image.

12. An image forming apparatus as set forth in claim 7, wherein the processing means includes take-out means for taking out sheets each formed with an image to stack the sheets in a predetermined stack section.

13. An image forming apparatus as set forth in claim 7, further comprising informing means for, when the error occurs in the processing means, informing a user of the occurrence of the error.

14. An image forming apparatus as set forth in claim 7, wherein the processing means includes a plurality of functional sections for performing different operations on a sheet formed with an image, the image forming apparatus further comprising informing means for, when an error occurs in any of the functional sections, informing a user of which functional section causes the error.

15. An image forming apparatus comprising:

image forming means for forming an image on a sheet;

processing means for performing predetermined process on a sheet formed with an image;

error informing means for outputting an error occurrence signal when an error occurs in the processing means;

control means for prohibiting the processing means from performing the predetermined process and permitting the image forming means to perform image formation in response to the error occurrence signal outputted from the error informing means, and said image forming apparatus further comprising means for outputting error type identification data indicative of an error type, wherein the control means includes:

means for once prohibiting the image formation when an error occurs in the processing means;

means for judging on the basis of the error type identification data whether or not the error is a noncritical one which can be readily removed;

means for, if it is determined that the error is noncritical, withdrawing the prohibition of the image formation performed by the image forming means after the error has been removed; and means for, if it is determined that the error is critical, permitting the image forming means to perform the image formation while prohibiting the processing means from performing the process.

16. An image forming apparatus as set forth in claim 15, wherein the processing means includes a sorting mechanism for sorting and discharging a plurality of sheets each formed with an image into a plurality of bins.

17. An image forming apparatus as set forth in claim 15, wherein the processing means includes stapling means for stapling a plurality of sheets each formed with an image.

18. An image forming apparatus as set forth in claim 15, wherein the processing means includes punching means for punching a sheet formed with an image.

19. An image forming apparatus as set forth in claim 15, wherein the processing means includes take-out means for taking out sheets each formed with an image to stack the sheets in a predetermined stack section.

20. An image forming apparatus as set forth in claim 15, further comprising informing means for, when the error occurs in the processing means, informing a user of the occurrence of the error.

21. An image forming apparatus as set forth in claim 15, wherein the processing means includes a plurality of functional sections for performing different operations on a sheet formed with an image, the image forming apparatus further comprising informing means for, when an error occurs in any of the functional sections, informing a user of which functional section causes the error.

22. An image forming apparatus comprising:

image forming means for forming an image on a sheet;

processing means for performing a predetermined process on a sheet formed with an image, the processing means being physically disconnectable from a machine body of the image forming apparatus;

disconnection judging means for judging whether or not the processing means is physically disconnected from the machine body;

error judging means for judging whether or not an error occurs in the processing means; and control means for, when an error occurs in the processing means, permitting the image forming means to perform image formation on condition that the disconnection judging means determines that the processing means is disconnected from the machine body and wherein the processing means includes a plurality of functional sections for performing different operations on a sheet formed with an image;

the disconnection judging means includes means for judging whether or not any of the functional sections is disconnected;

the image forming apparatus further comprising means for outputting error section identification data indicative of which functional section causes an error;

wherein, on condition that the functional section specified by the error section identification data is disconnected, the control means permits the other normal sections to perform their respective processes, and permits the image forming means to perform the image formation.

23. An image forming apparatus as set forth in claim 22, further comprising means for informing a user of a need to disconnect the processing means when the error occurs in the processing means.

24. An image forming apparatus as set forth in claim 22, further comprising means for informing a user of a need to disconnect the functional section causing the error.

25. An image forming apparatus as set forth in claim 22, wherein the machine body is formed with an attachment portion to which a discharge tray for receiving a sheet formed with an image is attachable;

the image forming apparatus further comprising attachment judging means for judging whether or not the discharge tray is attached to the attachment portion;

wherein, when the error occurs in the processing means, the control means permits the image forming means to perform the image formation on condition that it is determined in the attachment judging means that the discharge tray is attached to the attachment portion.

26. An image forming apparatus as set forth in claim 22, wherein the processing means is a sorter including a sorting mechanism for sorting and discharging a plurality of sheets each formed with an image into a plurality of bins.

27. An image forming apparatus as set forth in claim 22, wherein the processing means includes stapling means for stapling a plurality of sheets each formed with an image.

28. An image forming apparatus as set forth in claim 22, wherein the processing means includes punching means for punching a sheet formed with an image.

29. An image forming apparatus as set forth in claim 22, wherein the processing means includes take-out means for taking out sheets each formed with an image to stack the sheets in a predetermined stack section.

30. An image forming apparatus comprising:

image forming means for forming an image on a sheet;

processing means for performing a predetermined process on a sheet formed with an image, the processing means being physically disconnectable from a machine body of the image forming apparatus;

disconnection judging means for judging whether or not the processing means is physically disconnected from the machine body;

error judging means for judging whether or not an error occurs in the processing means; and control means for, when an error occurs in the processing means, permitting the image forming means to perform image formation on condition that the disconnection judging means determines that the processing means is disconnected from the machine body and wherein the control means includes:

means for prohibiting the image forming means from performing the image formation in response to the occurrence of the error in the processing means; and means for withdrawing the prohibition of the image formation performed by the image forming means if it is thereafter determined in the disconnection judging means that the processing means is physically disconnected from the machine body.

31. An image forming apparatus as set forth in claim 30, further comprising means for outputting error type identification data indicative of an error type, wherein the control means further includes means for judging on the basis of the error type identification data whether or not the error is a noncritical one which can be readily removed, and means for, if it is determined that the error is noncritical, withdrawing the prohibition of the image formation performed by the image forming means after the error has been removed.

32. An image forming apparatus as set forth in claim 30, further comprising means for informing a user of a need to disconnect the processing means when the error occurs in the processing means.

33. An image forming apparatus as set forth in claim 30, wherein the machine body is formed with an attachment portion to which a discharge tray for receiving a sheet formed with an image is attachable;

the image forming apparatus further comprising attachment judging means for judging whether or not the discharge tray is attached to the attachment portion;

wherein, when the error occurs in the processing means, the control means permits the image forming means to perform the image formation on condition that it is determined in the attachment judging means that the discharge tray is attached to the attachment portion.

34. An image forming apparatus as set forth in claim 30, wherein the processing means is a sorter including a sorting mechanism for sorting and discharging a plurality of sheets each formed with an image into a plurality of bins.

35. An image forming apparatus as set forth in claim 30, wherein the processing means includes stapling means for stapling a plurality of sheets each formed with an image.

36. An image forming apparatus as set forth in claim 30, wherein the processing means includes punching means for punching a sheet formed with an image.

37. An image forming apparatus as set forth in claim 30, wherein the processing means includes take-out means for taking out sheets each formed with an image to stack the sheets in a predetermined stack section.

* * * * *